US012139908B2

(12) United States Patent
Laydera-Collins et al.

(10) Patent No.: US 12,139,908 B2
(45) Date of Patent: Nov. 12, 2024

(54) SUSPENDED CEILING PANEL HOLDING CLIP

(71) Applicant: Gordon Sales, Inc., Bossier City, LA (US)

(72) Inventors: Imack Laydera-Collins, Benton, LA (US); Steven Jeremy Shugarts, Bossier City, LA (US); Daniel E. Smiley, Benton, LA (US)

(73) Assignee: Gordon Sales, Inc., Bossier City, LA (US)

( * ) Notice: Subject to any disclaimer, the term of this patent is extended or adjusted under 35 U.S.C. 154(b) by 0 days.

(21) Appl. No.: 17/492,203

(22) Filed: Oct. 1, 2021

(65) Prior Publication Data

US 2022/0106788 A1 Apr. 7, 2022

Related U.S. Application Data

(60) Provisional application No. 63/086,357, filed on Oct. 1, 2020.

(51) Int. Cl.
*E04B 9/20* (2006.01)
*E04B 9/24* (2006.01)

(52) U.S. Cl.
CPC ..... *E04B 9/205* (2013.01); *E04B 9/242* (2013.01); *E04B 9/245* (2013.01)

(58) Field of Classification Search
CPC ..... E04B 9/205; E04B 9/245; E04B 9/242; E04B 9/064; E04B 9/068; E04B 9/26
See application file for complete search history.

(56) References Cited

U.S. PATENT DOCUMENTS 4,679,375 A * 7/1987 Shirey ..... E04B 9/242 52/777
4,873,809 A * 10/1989 Paul ..... E04B 9/242 52/506.07
7,062,886 B2 6/2006 Auriemma
8,997,426 B1 4/2015 McLeod et al.
2004/0068953 A1* 4/2004 Sauer ..... E04B 9/28 52/745.05

FOREIGN PATENT DOCUMENTS

GB 1030796 A * 5/1966
GB 1104685 A * 2/1968
GB 1171363 A * 11/1969
GB 1181157 A * 2/1970

* cited by examiner

*Primary Examiner* — Adriana Figueroa
(74) *Attorney, Agent, or Firm* — Jones Walker LLP

(57) ABSTRACT

A hold down clip for retaining one or more ceiling panels on lower flanges of a suspended ceiling tee and allowing removal of the ceiling panels from below after installation. The hold down clip includes at least one outward curved section with a crest between an upper end and a lower end. The clip elastically deforms to produce reactive spring forces when a ceiling panel engages a contact point below the crest of the outward curved section. The clip also includes at least one continuously formed latching section, which may extend from the upper end, lower end, or a transition point below the crest of the outward curved section. The latching section engages the grid tee to generate the spring force. Alternatively, the clip includes a fastener secured to the at least one outward curved section. The fastener is configured for threaded attachment to a receptacle of the grid tee.

8 Claims, 26 Drawing Sheets

SUSPENDED CEILING PANEL HOLDING CLIP

CROSS-REFERENCE TO RELATED APPLICATION

The application claims the benefit of and priority to U.S. Provisional Patent Application No. 63/086,357 filed on Oct. 1, 2020, which is incorporated herein by reference in its entirety.

FIELD OF THE INVENTION

The present invention relates to clips, and more particularly to clips designed to attach to a suspended ceiling tee with the purpose of holding down the suspended ceiling panels in such a way that it is pressed against the tee's lower flange.

BACKGROUND

In construction of buildings the typical unfinished ceiling plenum space (i.e., the space above a suspended ceiling) is roughly finished, non-insulated and/or occupied by electrical conductors, water pipes, air conditioning ducting, etc. A suspended ceiling system conceals all these utilities, provides thermal insulation, sound proofing, an aesthetically pleasant finish, and offers easy installation for illumination, sound, air conditioning vents, fire protection, and many other treats. The typical suspended ceiling is an array of aluminum extrusions or formed steel profiles in the shape of an inverted tee that are laid out in a rectangular pattern leaving open spaces to be filled by ceiling panels. This array of supporting structure is anchored to the room deck or structural members. The panels are seated over the lower flanges of the metal tees and are typically held down by gravity.

In many instances, when the suspended ceiling panels are too light, internal pressure inside the room and occasional pressure bursts may lift the panels out of their seating pockets. Also, it is important to keep these panels secured in position for fire protection. In clean rooms with suspended ceilings, there is an emphasis for maintaining the room sealed from exterior contamination. Likewise, suspended ceilings must be kept air tight in data centers in order to maintain air movement for temperature control. These requirements justify the use of hold down devices to maintain the panels secured and sealed against the tee's lower flange. In other applications, the hold down devices are used to reduce vibration and noise and to maintain the panels' fully seated position on the tee's flange for aesthetic reasons.

One disadvantage of many conventional hold down devices is that the clips do not allow for removal of the panels for accessibility to the inner plenum space between the suspended ceiling and upper deck unless certain panels are left purposely removable. The accessibility to the plenum space is necessary for maintenance of electrical conductors, lamps, and any other accessory or device that is above or attached to the suspended ceiling. Other conventional hold down clips that allow for removal of the ceiling panels fit closely to the suspended ceiling tee, which results either in the clips providing an insufficient downward force on the ceiling panel to hold the panel in place or the clips not contacting the ceiling panels at all.

There is a need for a device that maintains ceiling panels in position firmly against the suspended ceiling tee's lower flange, while still allowing easy panel removal to access the space above the suspended ceiling from the side of the room below.

SUMMARY

The present invention relates to a clip for holding down suspended ceiling panels. The clip is configured to hold down suspended ceiling panels and at the same time allows easy insertion and indefinite removal of panels without damaging the panels or the clips. In some embodiments, the hold down clip includes a first outward curved section and a continuously formed first latching section. The first outward curved section extends from an upper end to a lower end with a crest between the upper and lower end. The first latching section extends in an inward direction from a transition point along the first outward curved section. The first latching section is configured to engage and exert an inward force on a grid tee of a suspended ceiling to cause the first outward curved section to apply an outward spring force on a ceiling panel disposed on a horizontal flange of the grid tee. In certain embodiments, the transition point may be positioned at the lower end of the first outward curved section, and an upper end of the first latching section may be configured to engage a shoulder of the grid tee. In certain embodiments, the hold down clip may further include a second latching section configured to engage the grid tee. In certain embodiments, the clip may further include a bridge section extending from the upper end of the first outward curved section and a second latching section extending from the bridge section. The bridge section is configured to fit over an upper end of the grid tee to position the first outward curved section and the first latching section along a first side of the grid tee. Alternatively, the hold down clip may further include a bridge section interconnecting the first outward curved section with a second outward curved section, and a second latching section extending from a lower end of the second outward curved section.

In other embodiments, the hold down clip is configured to engage only one side of a grid tee of a suspended ceiling, with the clip including a first outward curved section and a continuously formed first latching section extending from an upper end of the first outward curved section. The first latching section is configured to engage and exert an inward force on a grid tee to cause the first outward curved section to apply an outward spring force. In certain embodiments, the first latching section may be configured to engage a receptacle on a side of the grid tee. Alternatively, the first latching section may be configured to engage an upper receptacle of the grid tee. The first latching section may include a U-shaped portion configured to fit within the receptacle or the upper receptacle.

In still other embodiments, the hold down clip includes a bridge section interconnecting a first outward curved section and a first latching section, with the bridge section configured to fit over an upper end of a grid tee of a suspended ceiling to position the first outward curved section along a first side of the grid tee and to position the first latching section along a second side of the grid tee. The first outward curved section and the first latching section are configured to elastically deform to produce reactive forces when in contact with a ceiling panel.

In yet other embodiments, the hold down clip includes a fastener secured to the upper end of a first outward curved section. The fastener is configured to threadedly engage a threaded upper receptacle of a grid tee of a suspended ceiling to position the first outward curved section along a first side of the grid tee in a configuration in which the first outward curved section is configured to elastically deform to produce reactive forces when in contact with a compressive element. In certain embodiments, the clip further includes a second outward curved section secured to the fastener such that the second outward curved section is positioned along a second side of the grid tee when the fastener is secured to the threaded upper receptacle.

Other objects, advantages and variations of the present invention, will become apparent and obvious from a study of the following detailed description and accompanying drawings which are merely illustrative of such invention.

BRIEF DESCRIPTION OF THE DRAWING VIEWS

FIG. 1*a*-1*d* are schematic illustrations of typical aluminum extruded and metal formed tees used for suspended ceiling.

DETAILED DESCRIPTION OF SELECTED EMBODIMENTS

Figure 1C:
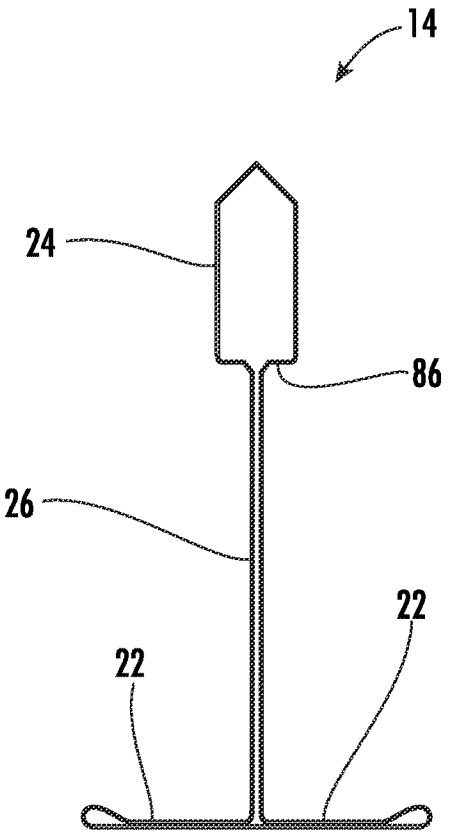
FIG. 1C (PRIOR ART)

Disclosed herein is a hold down clip configured to hold one or more ceiling panels down in contact with a lower flange of a suspended ceiling tee and to allow the ceiling panel to be removed from below after installation without damaging the ceiling panel or the hold down clip. The hold down clip is configured to engage a grid tee of a suspended ceiling in a manner that causes the hold down clip to apply a spring force on an adjacent ceiling panel. The spring force may include a force directed to the ceiling panel away from the grid tee and a downward force. The hold down clip includes at least one outward curved section extending from an upper end and a lower end, with a crest between the upper and lower ends. The hold down clip is configured to be secured to a grid tee such that a lower portion of the outward curved section applies the spring force to the ceiling panel. The hold down clip may further include a latching section extending from the outward curved section. The latching section may be continuously formed with the outward curved section. The latching section may be configured to engage and exert an inward force on the grid tee to cause the lower section of the outward curved section to apply the spring force. The latching section may extend in an inward direction and an upward direction from a transition point between the crest and the lower end of the outward curved section. Alternatively, the latching section may extend from an upper end of the outward curved section. In yet other alternatives, the latching section may extend in an inward direction and a downward direction. In some embodiments, the hold down clip further includes a bridge section that is configured to fit over an upper end of the grid tee to position the outward curved section along a first side of the grid tee. In further embodiments, the hold down clip may include a bridge section interconnecting two outward curved sections and two latching sections configured to position one of the outward curved sections along each side of the grid tee. In other embodiments, the bridge section is configured to position one outward curved section along a first side of the grid tee and to position one latching section on a second side of the grid tee. In still other embodiments, the hold down clip may include at least one outward curved section secured to a fastener, which is configured to engage a threaded opening in an upper end of a high strength grid tee. In this embodiment, the fastener positions the one or more outward curved sections along one or more sides of the grid tee such that the lower portion of the outward curved section applies the spring force to the ceiling panel.

Various embodiments of the panel hold down clip of the present invention are illustrated in FIGS. 2-23, with many other variations and embodiments apparent to a skilled artisan after reviewing this disclosure. The hold down clip can be constructed in various ways, but in some embodiments the hold down clip is manufactured with a single piece of light gauge metal that is heat treated to achieve a high degree of elasticity. The thickness of the light metal gauge is important to create the necessary force required to hold the ceiling panels down against the lower flange of the grid tees. Also, the hold down clip has a width sufficient to increase the bearing surface in contact with the ceiling panel, therefore reducing the specific pressure to avoid deformation of ceiling panels constructed of soft material. In other embodiments, the hold down clip is manufactured using a high performance plastic material that offers the same properties as the metallic counterpart.

Figure 1B:
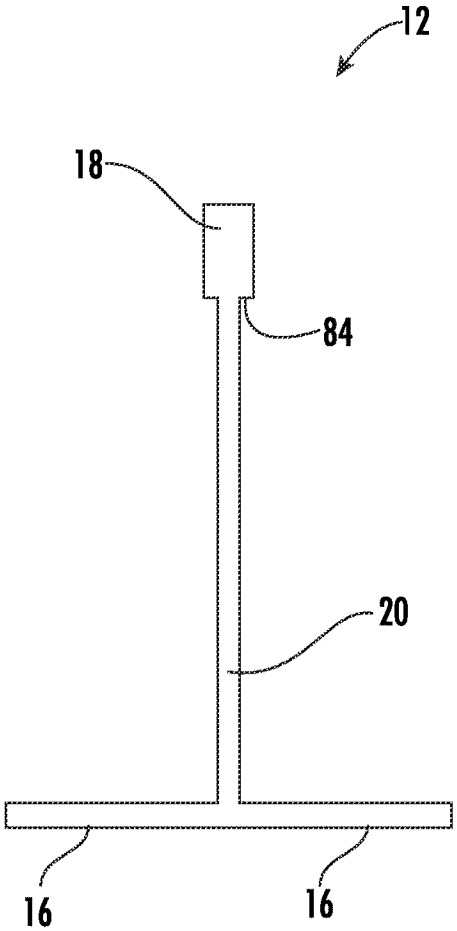
FIG. 1B (PRIOR ART)
Figure 1A:
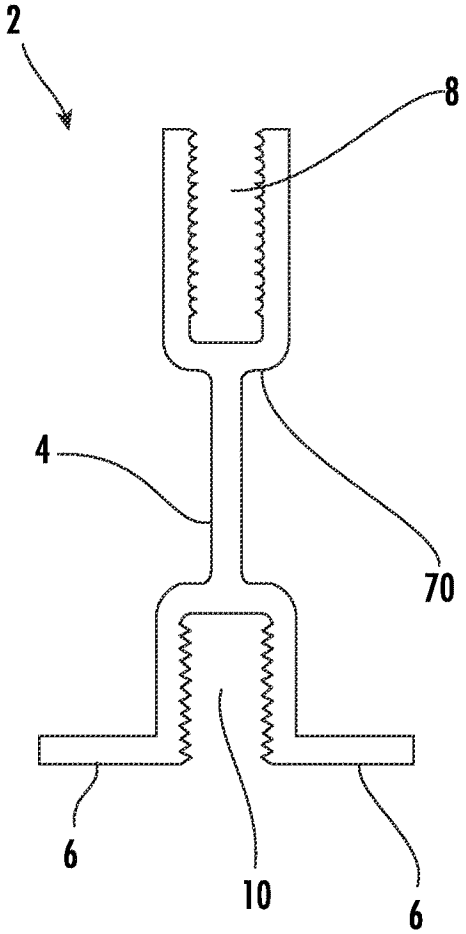
FIG. 1A (PRIOR ART)

FIGS. 1*a*-1*d* illustrate a few typical grid tee profiles used in suspended ceilings. Unless otherwise noted, each embodiment of the hold down clip of the present invention may be secured on any of the grid tee profiles. FIG. 1*a* shows a high strength grid tee 2 commonly used in data centers. These high strength tees 2 must be robust due to the loads that are typically applied to the suspended ceiling grid in their specific applications. The dimensional profile of tee 2 varies depending of the load requirements for the suspended ceiling structure. Tee 2 includes a vertical section 4 and horizontal flanges 6. The upper end of vertical section 4 includes threaded upper receptacle 8 with continuous threads. This threaded upper receptacle 8 is used to engage fasteners (not shown) that are used to join main tee sections and cross-tee segments using metal casting structures. The fasteners in cooperation with the threaded upper receptacle 8 are used to provide anchoring for lateral stabilizing structures. The two flanges 6 on the lower portion of the tee 2 are separated by a lower threaded slot 10. The lower threaded slot 10 is utilized to attach hanging elements from the grid structure. The upper side of the flanges 6 receive the suspended ceiling panels (not shown).

FIGS. 1*b* and 1*c* show grid tee 12 and grid tee 14, respectively, which are both generally used on suspended ceilings with lower load requirements. These grids using low strength tees 12 and 14 are found in general commercial construction such as conference rooms, working rooms, and all other areas where the rough construction ceiling is aesthetically unpleasant. Tees 12 and 14 do not include threaded grooves. Instead, tee 12 has a plain flat lower portion including horizontal flanges 16 on both sides and a web 18 at the upper end of vertical section 20. Similarly, tee 14 has a plain flat lower portion including horizontal flanges 22 on both sides and a web 24 at the upper end of vertical section 26. Webs 18 and 24 are each used to strengthen tees 12 and 14, respectively, against bending and compressible forces.

Figure 1D:
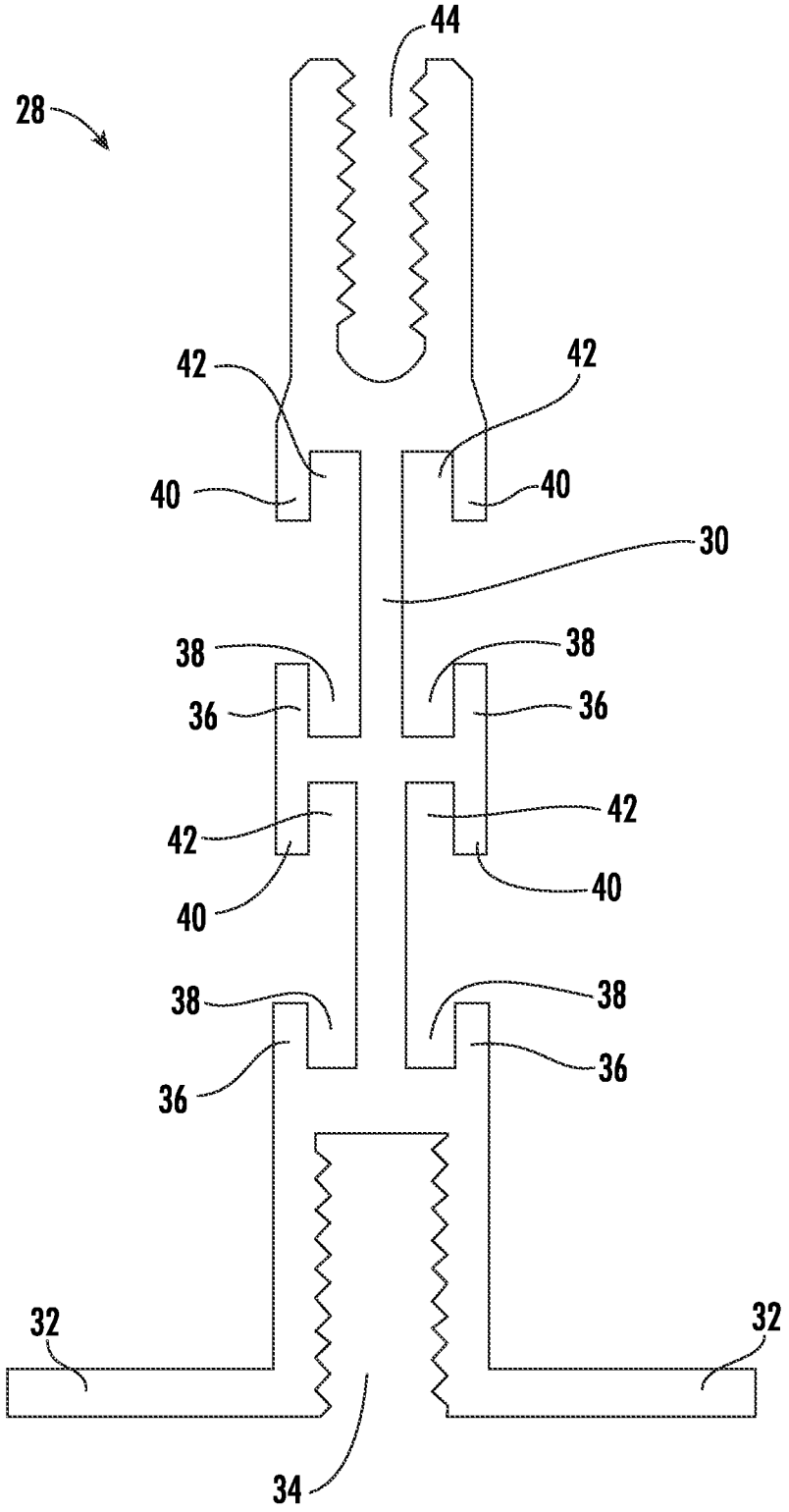
FIG. 1D (PRIOR ART)

FIG. 1*d* shows tall grid tee 28, which is generally used on suspended ceilings where very high loads are suspended from underneath the tees, such as electrical panels, conveyor rails, interconnection boxes, etc. Tee 28 includes vertical section 30 and horizontal flanges 32 separated by threaded lower slot 34, which is used to engage fasteners to hold panels, rails, boxes, or other items suspended from the tees. Both sides of vertical section 30 include upward facing shoulders 36 that create upward facing receptacles 38 and downward facing shoulders 40 that create downward facing receptacles 42. The upper end of vertical section 30 includes threaded upper slot 44, which is used for engaging fasteners to hold cross tees connected to main tees. The fasteners usually hold a cast structure that structurally holds the cross tees to the main tees. Receptacles 38 and 42 provide anchoring means to lateral accessories such as clips and lamps.

Figure 2:
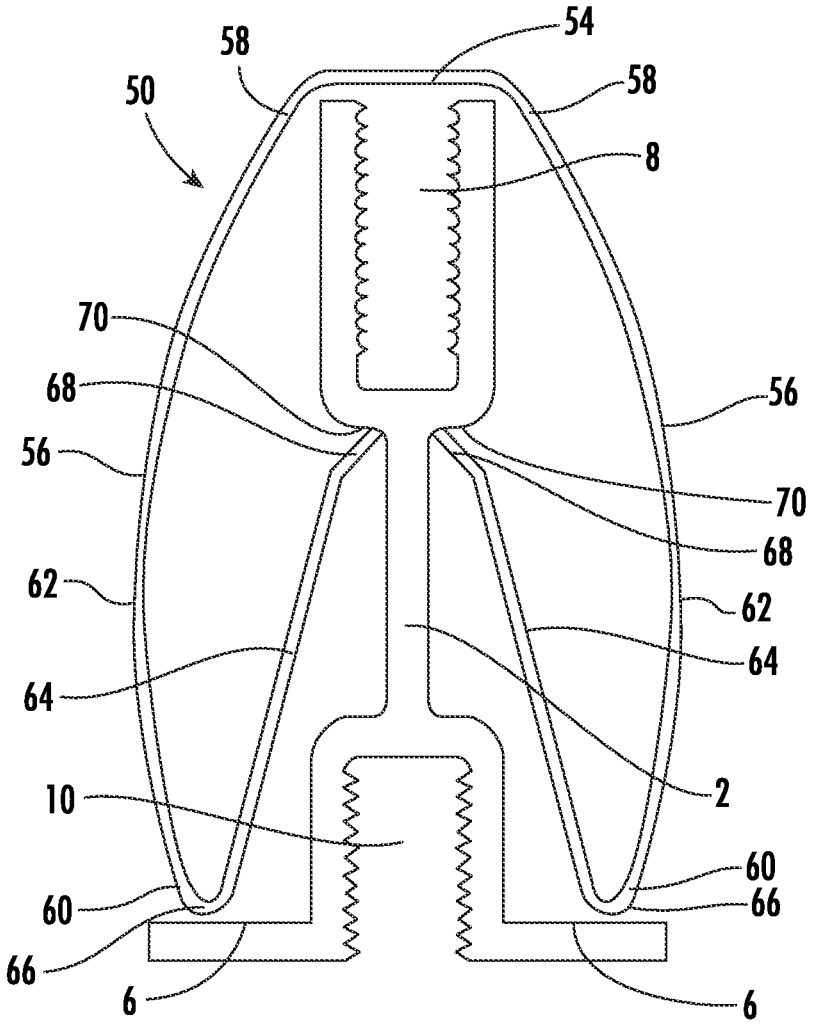
FIG. 2 is a side view of one embodiment of a hold down clip installed over a high strength tee.
Figure 3:
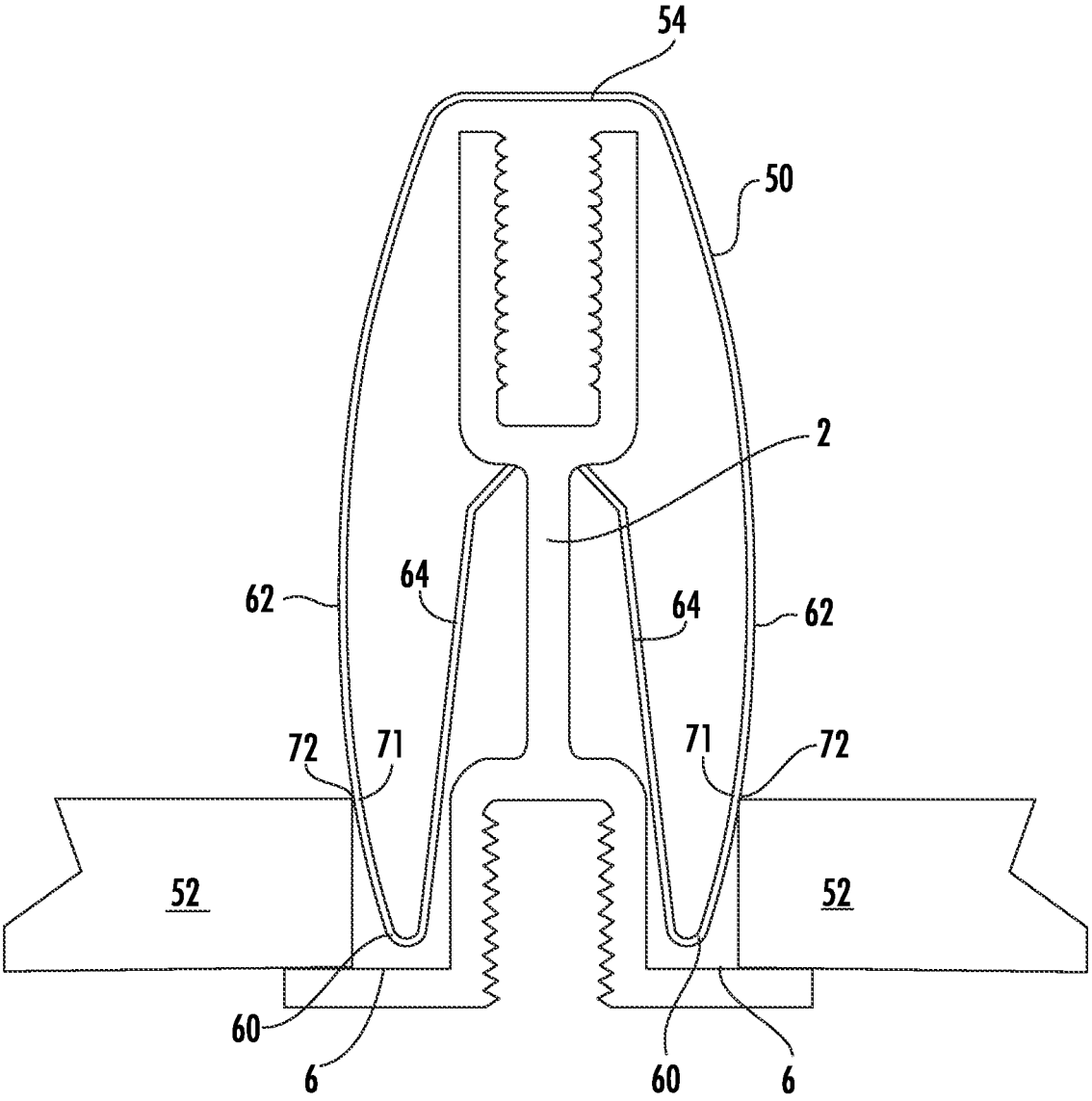
FIG. 3 is a side view of the panel hold down clip and tee of FIG. 2 with ceiling panels installed.

FIGS. 2 and 3 illustrate hold down clip 50 disposed on high strength tee 2. Clip 50 is symmetrical on both sides of the central vertical axis of high strength tee 2. The symmetry is beneficial because ceiling panels 52 are seated on both horizontal flanges 6 of tee 2 and the clip 50 creates a balanced force as it is deformed equally on both sides of tee 2. Hold down clip 50 is manufactured as one continuous strip. The clip 50 includes a bridge section 54 configured to be positioned over the upper end of grid tee 2. In the illustrated embodiment, bridge section 54 of clip 50 has a flat shape. Bridge section 54 joins the two symmetrical sides of the clip 50. Each side of clip 50 includes an outward curved section 56 extending from bridge section 54, such that clip 50 includes a first outward curved section 56 disposed on a first side of grid tee 2 and a second outward curved section 56 disposed on a second side of grid tee 2. Each outward curved section 56 extends from upper end 58 to lower end 60 and includes crest 62 between upper end 58 and lower end 60. Crest 62 is the point along each outward curved section 56 that is positioned at the greatest distance from the central axis of grid tee 2. In other words, crest 62 is the highest abutment on outward curved section 56. Outward curved section 56 curves outward from upper end 58 to crest 62 and curves inward from crest 62 to lower end 60.

Each side of hold down clip 50 also includes a latching section 64 extending in an inward direction and an upward direction from lower end 60 of outward curved section 56. As used herein, "inward direction" means a direction that approaches or moves closer to the vertical portion of a grid tee such that the element is positioned between the grid tee and an outer frame formed by an outer curved section. At lower end 60 of each outward curved section 56 is a slightly sharp bend 66 which joins the outward curved section 56 with the latching section 64. In one embodiment, the upper end 68 of each latching section 64 includes an inward sloped section. The upper ends 68 of latching sections 64 will engage downward facing shoulder 70 of grid tee 2, which is disposed on the outside lower portion of the threaded upper receptacle 8. The engagement of upper end 68 of latching section 64 with grid tee 2 does not allow the clip 50 to move upwards.

While hold down clip 50 is being installed on grid tee 2, the latching sections 64 and the outward curved sections 56 spring in an outward direction, which allows the upper ends 68 of the latching sections 64 to slide over the outside surface of the threaded upper receptacle 8. After passing this section of grid tee 2, the upper ends 68 of latching sections 64 of clip 50 engage downward facing shoulder 70 of grid tee 2. The geometry of outward curved sections 56 allows ceiling panels 52 to slide downward over the upper portions of outward curved sections 56 and, once past crests 62, the ceiling panels 52 will be forced down by the lower portions of outward curved sections 56 below crests 62. When ceiling panels 52 are positioned on horizontal flanges 6 as shown in FIG. 3, contact points 71 of the outward curved sections 56 of the clip 50 are in contact with upper edges 72 of ceiling panels 52. Upper ends 68 of latching sections 64 exert an inward force on the grid tee 2, which results in an outward spring force on the lower portion (i.e., between crest 62 and lower end 60) of outward curved section 56. The lower portion of outward curved section 56 applies the outward spring force on the upper edges 72 of ceiling panels 52.

Upper ends 70 of latching sections 64, which are positioned inside of outward curved sections 56, positively engage grid tee 2 to extend outward curved sections 56 a greater distance away from the grid tee than prior art hold down clips. This configuration enables clip 50 to retain ceiling panels in systems having a larger clearance between the ceiling panels and the grid tee, which would not be sufficiently retained by prior art devices. Additionally, the spring force does not rely on the deflection force of bridge section 54 and the curved sections of clip 50. Instead, clip 50 applies a constant spring force to retain ceiling panels on the grid tee. In this way, outward curved sections 56 are configured to elastically deform to produce reactive forces when in contact with a compressive element, such as a ceiling panel, in addition to the elastic forces applied by the latching sections 64 over the end of the inward bend 66.

Figure 4:
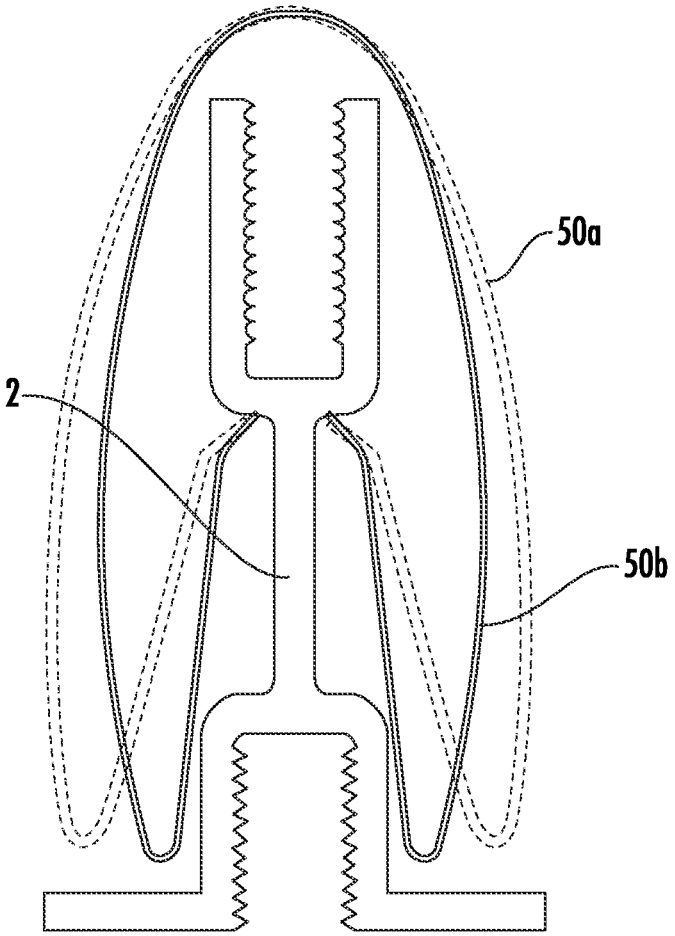
FIG. 4 is a schematic illustration of the deflection of the hold down clip of FIG. 2.

As shown in FIG. 4, panel hold down clip 50 deforms to accommodate the ceiling panels and to apply pressure to hold them down. Clip 50*a* is shown in its natural relaxed state. Clip 50*b* is shown in its deformed state as it receives pressure from the ceiling panels on both sides of the grid tee 2.

Figure 5:
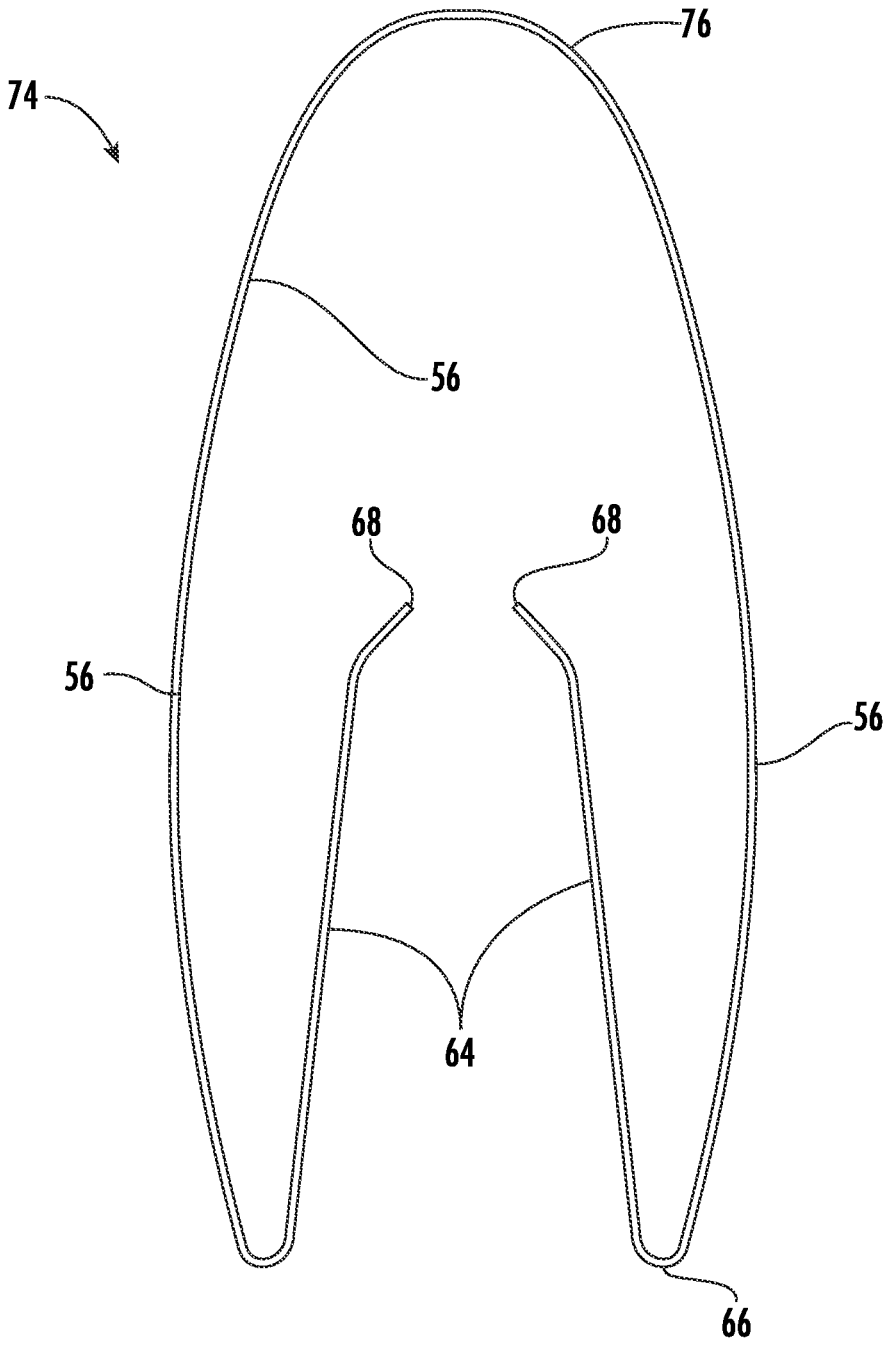
FIG. 5 is a side view of a second embodiment of a hold down clip.

FIG. 5 illustrates a second embodiment of the hold down clip of the present invention. Hold down clip 74 includes bridge section 76 having a rounded shape instead of the flat shape of bridge section 54 of clip 50. The rounded shape of bridge section 76 facilitates fabrication and increases flexibility. Except as otherwise noted, hold down clip 74 includes the same features and functions as hold down clip 50. Also, like reference numerals indicate like structural features in the various embodiments of the hold down clip disclosed herein.

Figure 6:
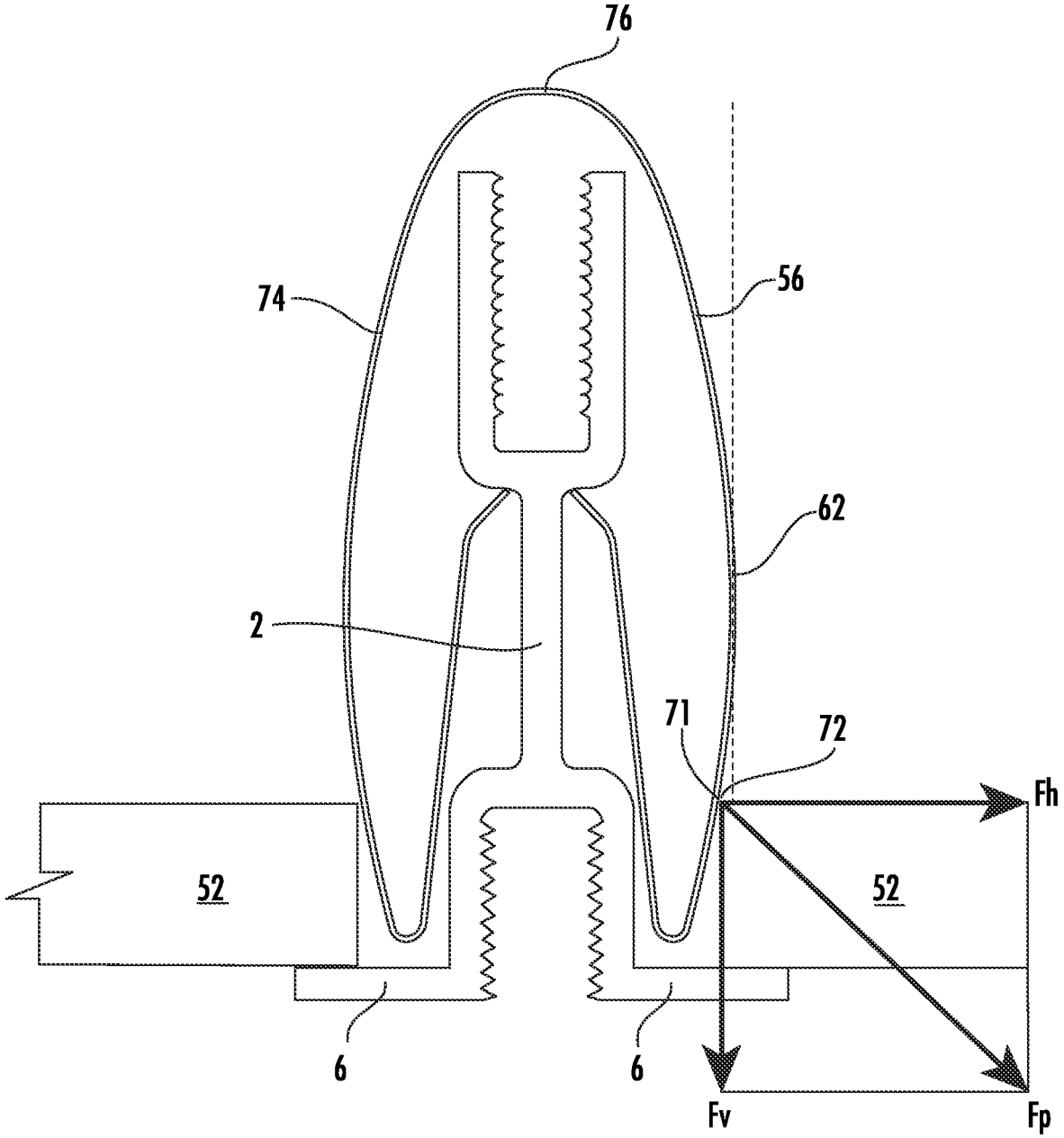
FIG. 6 is a side view of the hold down clip of FIG. 5 installed over a high strength tee, including a diagram of the forces applied by the hold down clip on installed ceiling panels.

With reference to FIG. 6, hold down clip 74 may be installed on a grid tee, such as grid tee 2, and ceiling panels 52 may be positioned on horizontal flanges 6. Contact points 71 on outward curved sections 56 of clip 74 engage upper edges 72 of ceiling panels 52. Each ceiling panel 52 compresses hold down clip 74 toward grid tee 2, which results in a spring force that applies a force $F_p$ on the ceiling panel 52 in the direction of the vector $F_p$. FIG. 6 shows a diagram of forces at point 71, which include a horizontal component $F_h$ and a vertical component $F_v$. The horizontal component $F_h$ creates a reaction that pushes the ceiling panel 52 horizontally away from grid tee 2. Because there will be another clip 74 on the opposite side pushing with $F_h$ in opposite direction, the panel horizontal motion becomes balanced and no movement results. $F_v$, is the vertical component of the vectorial forces. This vertical force $F_v$ pushes the ceiling panel 52 down against horizontal flange 6 of grid tee 2. A greater inclination of the angle of the tangent to the outward curved section 56 at contact point 71 generates a larger resulting $F_v$ pushing the ceiling panel 52 downwards. Thicker ceiling panels 52 result in a contact point 71 closer to crest 62, which results in a greater horizontal component of the force $F_h$ and a lower vertical component $F_v$. At this point the frictional forces are high and sufficiently hold the ceiling panel 52 in the down position. The outward curved section 56 of clip 74 may be modified to place crest 62 slightly higher to allow a contact point 71 below crest 62 for thicker panels. To remove ceiling panel 52 from grid tee 2, ceiling panel 52 is pushed up to override the vectorial forces as well as the frictional forces. The clip 74 will compress and then return to its original shape. All embodiments of the hold down clip of the present invention, including clip 50, provide the spring force features and functions described in connection with FIG. 6.

Figure 7:
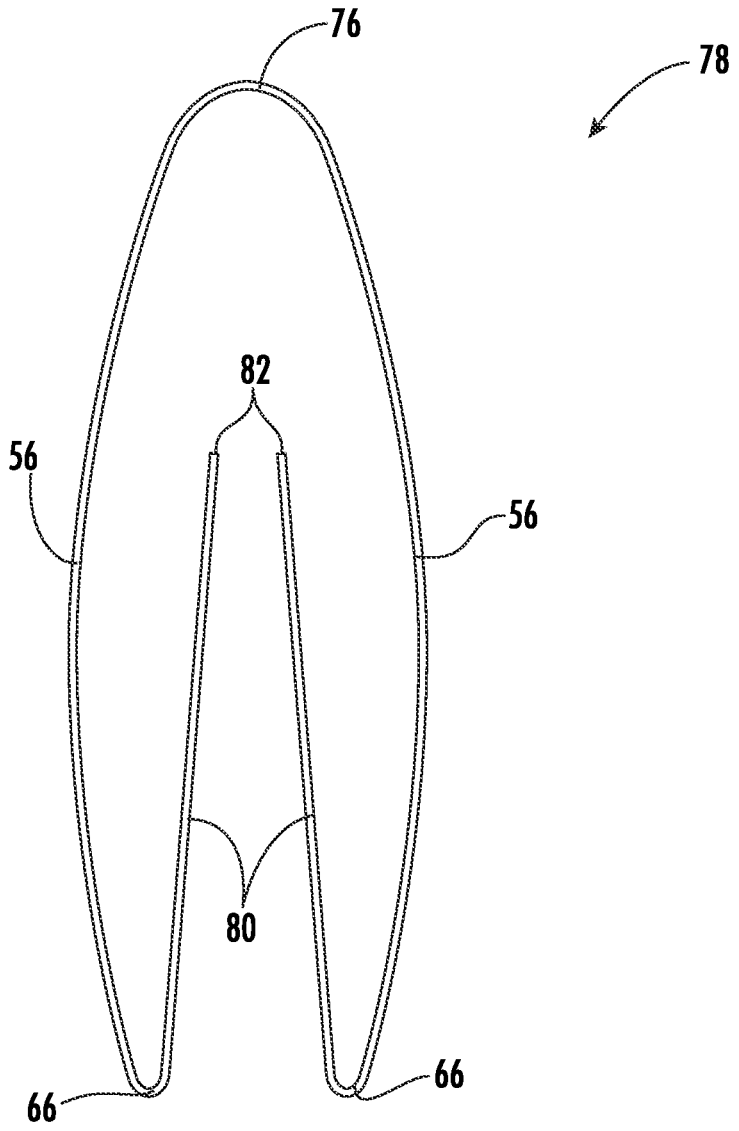
FIG. 7 is a side view of a third embodiment of a hold down clip.

FIG. 7 illustrates a third embodiment of the hold down clip of the present invention. Hold down clip 78 may include outward curved sections 56 interconnected by curved bridge section 76, along with latching sections 80 extending in an inward direction and an upward direction from the lower ends of outward curved sections 56. Latching sections 80 may be straight without inward sloped sections near upper ends 82. Latching sections 80 may be relatively longer than the latching sections of clips 50 and 74, which may decrease the spring force the latching sections 80 apply over outward curved sections 56. Except as otherwise noted, hold down clip 78 includes the same features and functions as hold down clips 50 and 74.

Figure 8:
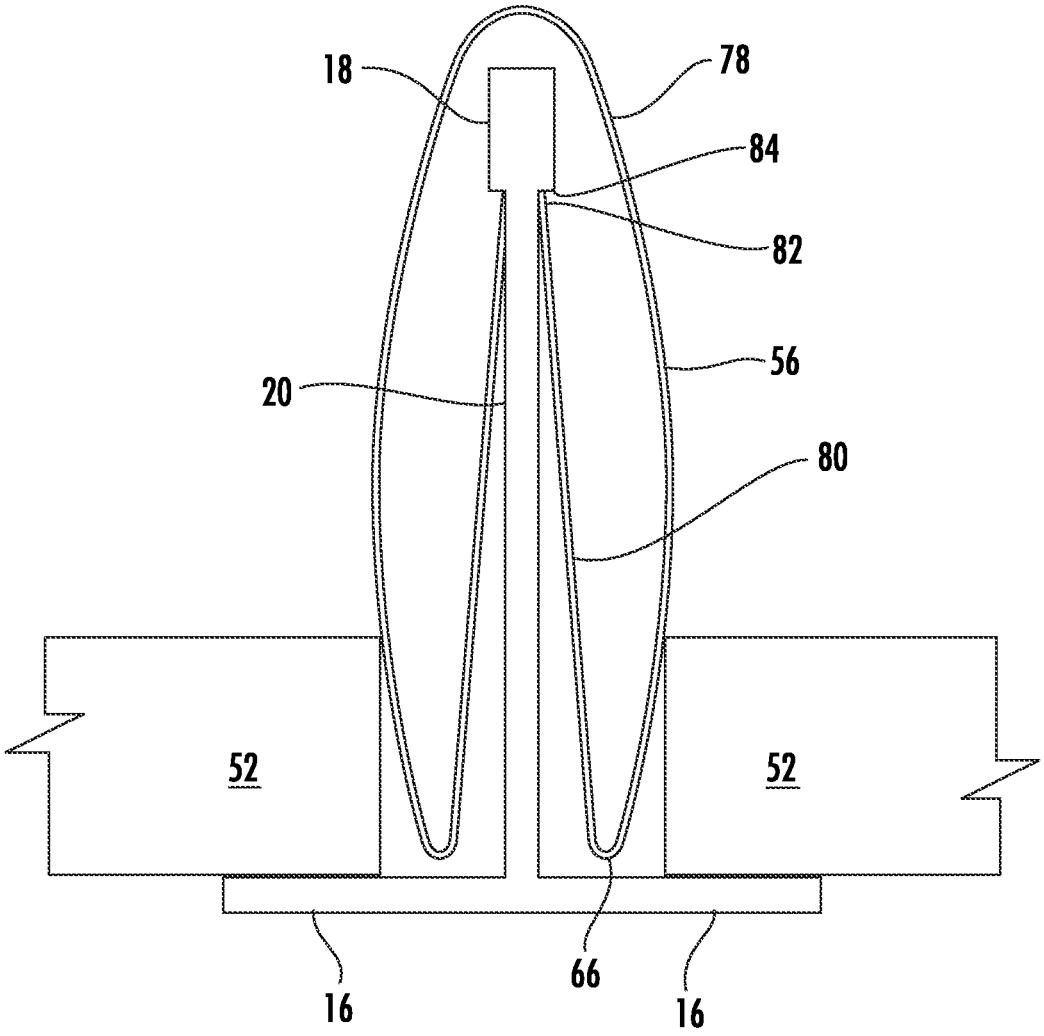
FIG. 8 is a side view of the hold down clip of FIG. 7 installed over a low strength tee with ceiling panels installed.

As shown in FIG. 8, hold down clip 78 may be installed on low strength grid tee 12 to retain ceiling panels 52 against horizontal flanges 16. Upper ends 82 of latching sections 80 may be configured to engage downward facing shoulder 84 of web 18 on grid tee 12. Hold down clip 78 functions similarly to clips 50 and 74 described above. Ceiling panels 52 compress outward curved sections 56 of clip 78 inward toward grid tee 12, which generates a spring force that outward curved sections 56 apply to the upper edges of ceiling panels 52. Because the upper edges of ceiling panels 52 engage outward curved sections 56 below the crest, the spring force includes a downward component, which pushes ceiling panels 52 toward horizontal flanges 16 to retain ceiling panels 52 in this position.

Figure 9:
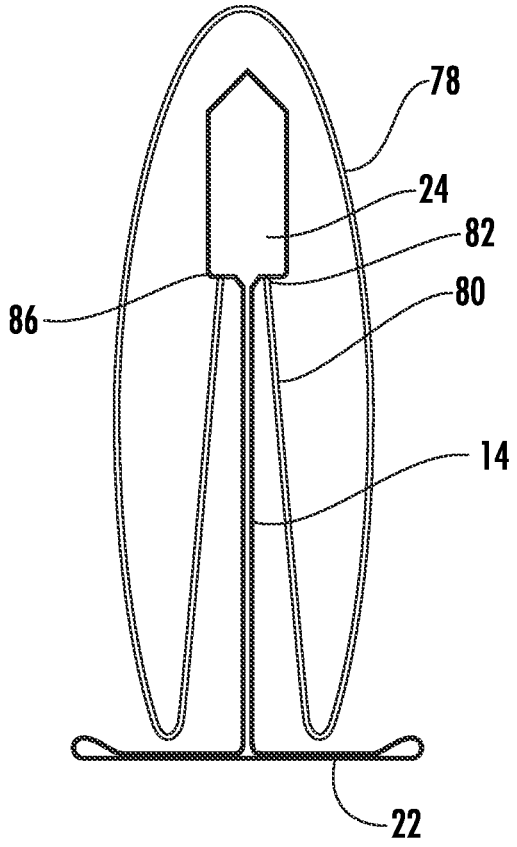
FIG. 9 is a side view of the hold down clip of FIG. 7 installed over a typical steel formed tee.

With reference to FIG. 9, hold down clip 78 may be installed on low strength grid tee 14 to retain ceiling panels against horizontal flanges 22. Upper ends 82 of latching sections 80 may be configured to engage downward facing shoulder 86 of web 24 on grid tee 14, which retains clip 78 on grid tee 14.

Figure 10:
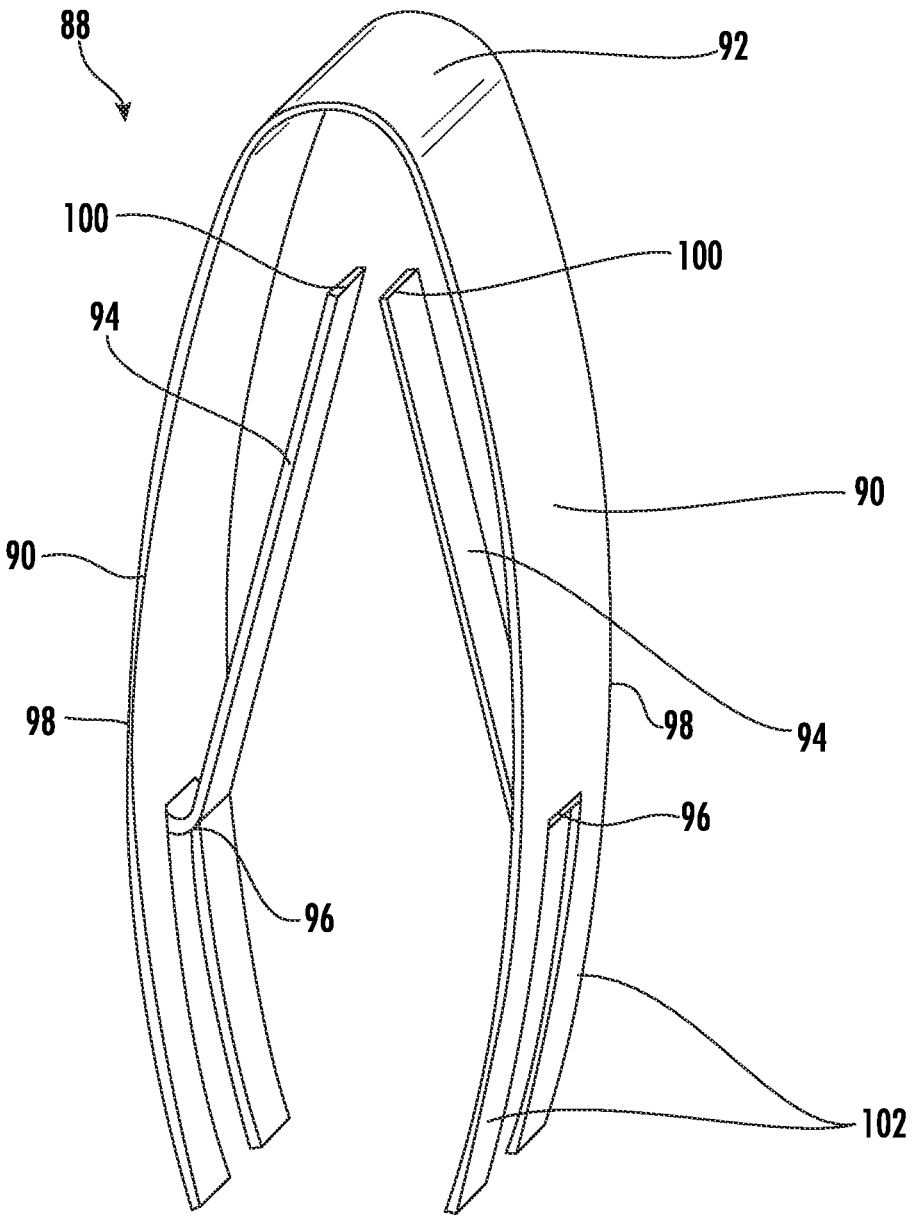
FIG. 10 is a perspective view of a fourth embodiment of a hold down clip.

FIG. 10 illustrates a fourth embodiment of the hold down clip of the present invention. Hold down clip 88 may include two outward curved sections 90 interconnected by curved bridge section 92, along with latching sections 94 extending in an inward direction and an upward direction from transition point 96 on outward curved sections 90. Outward curved sections 90 each extend from bridge section 92 to a lower end with crest 98 disposed between. Latching sections 94 may extend from transition points 96 to upper ends 100. In this embodiment, latching sections 94 are formed from a split portion of the outward curved sections 90 such that the transition point 96 is closer to crest 98 of outward curved sections 90. Specifically, the lower portions of outward curved sections 90 may be split into three segments along the width of sections 90. The outer segments 102 may continue the curve to form the lower ends of outward curved sections 90, while the middle segments may bend at transition point 96 and extend in the inward direction and the upward direction to form latching sections 94. Functionally, hold down clip 88 provides greater pushing force by use of shorter latching sections 94. Latching sections 94 produce horizontal forces over the outward curved sections 90 at points that are near crests 98. This configuration intensifies the push down force on tall grid tees. Hold down clip 88 may be used on grid tees without threaded slots. This configuration may be manufactured as a plastic extrusion retaining the same form and elements but converting the split outer segments 102 into a solid inward curve.

Figure 11:
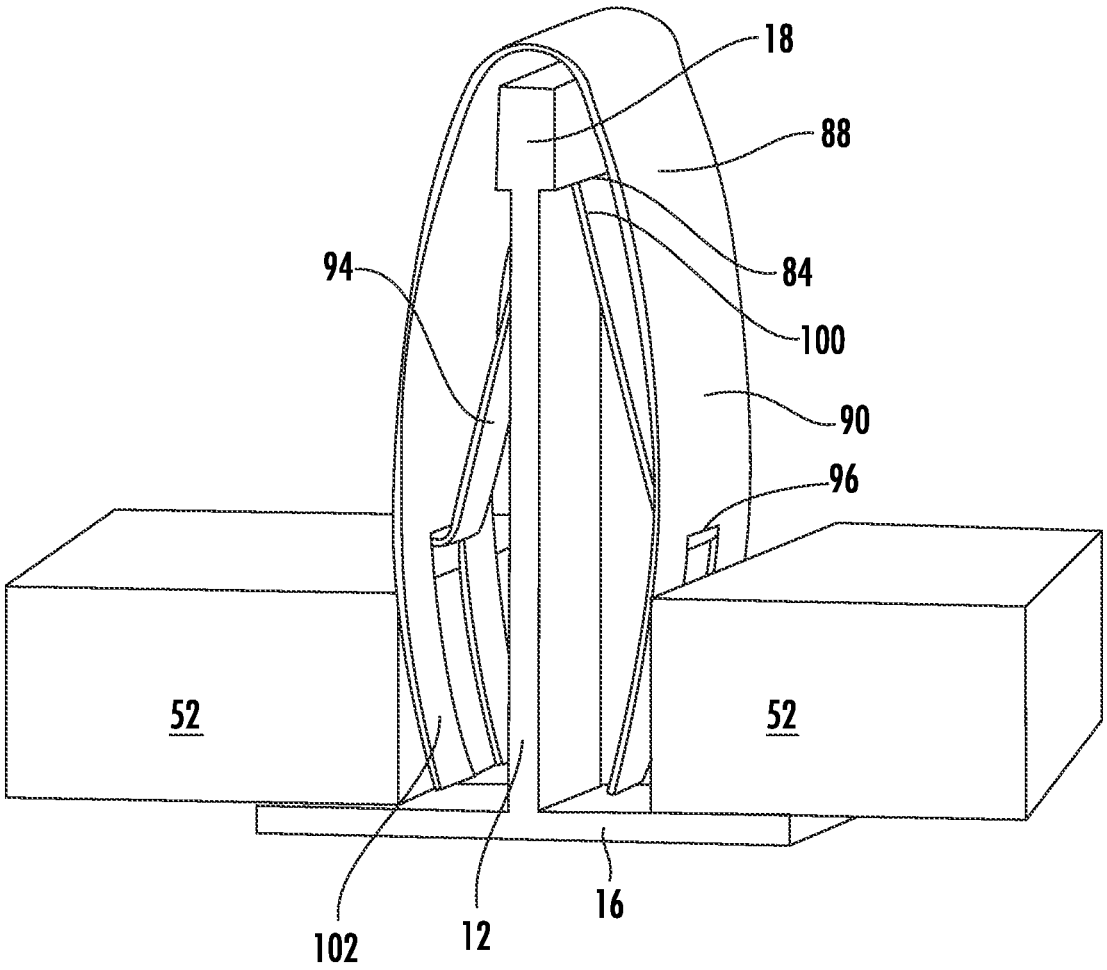
FIG. 11 is a perspective view of the hold down clip of FIG. 10 installed over a suspended ceiling tee with ceiling panels installed.

As shown in FIG. 11, hold down clip 88 may be installed on grid tee 12 of a suspended ceiling to retain ceiling panels 52 against horizontal flanges 16. Upper ends 100 of latching sections 94 may positively engage downward facing shoulder 84 of web 18 on grid tee 12 to secure hold down clip 88 on grid tee 12. As shown, the spring force provided by latching arms 94 pushes on outward curved sections 90 at a higher level, which provides a stronger vertical force component (i.e., push down force) on the ceiling panels 52.

Upper ends 100 of latching sections 94, which are positioned inside of outward curved sections 90, positively engage grid tee 12 to extend outward curved sections 90 a greater distance away from the grid tee than prior art hold down clips. This configuration enables clip 88 to retain ceiling panels in systems having a larger clearance between the ceiling panels and the grid tee, which would not be sufficiently retained by prior art devices. Additionally, the spring force does not rely on the deflection force of the curved sections of clip 88. Instead, clip 88 applies a constant spring force to retain ceiling panels on the grid tee. In this way, outward curved sections 90 and latching sections 94 are configured to elastically deform to produce reactive forces when in contact with a compressive element, such as a ceiling panel.

Figure 12:
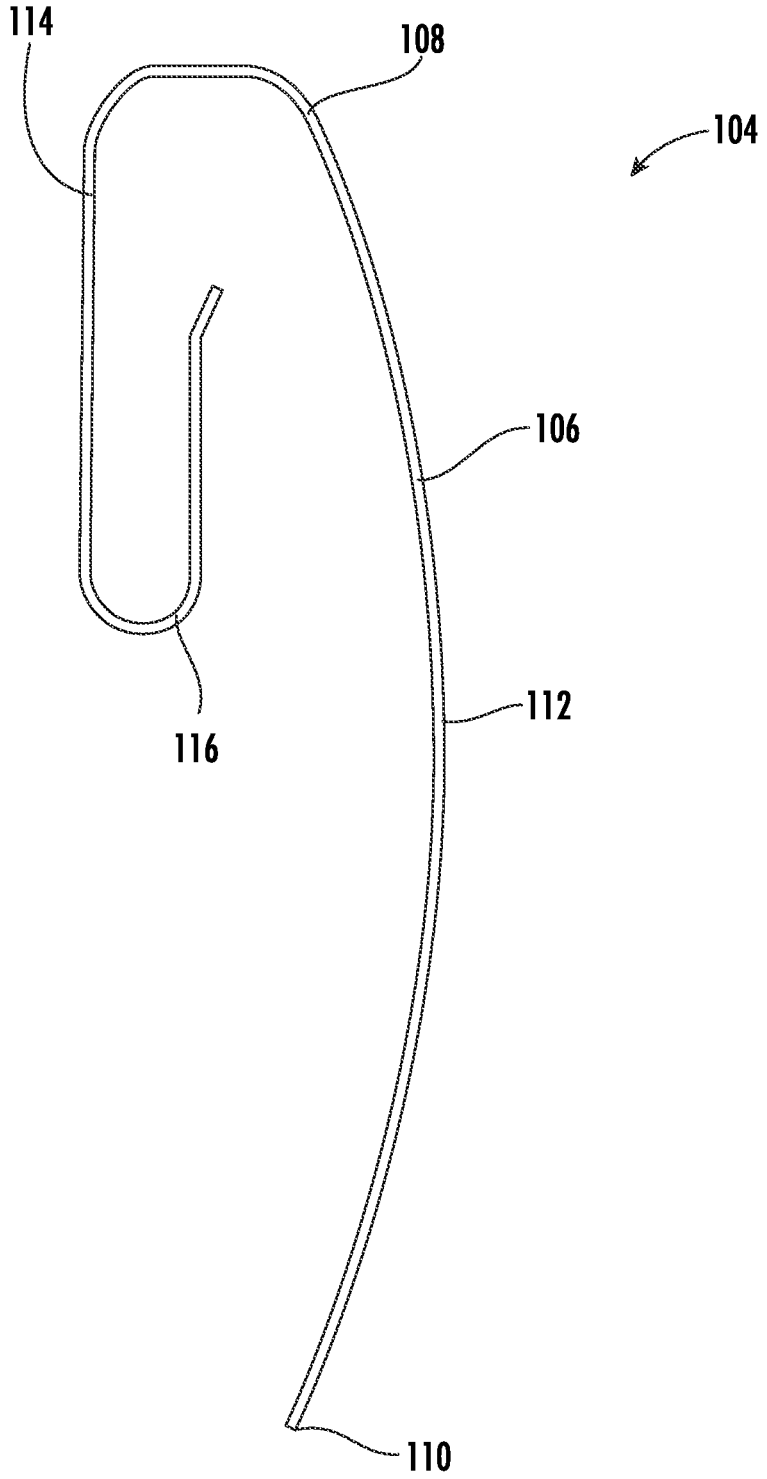
FIG. 12 is a side view of a fifth embodiment of a hold down clip.

FIG. 12 illustrates a fifth embodiment of the hold down clip of the present invention. Hold down clip 104 may include one outward curved section 106 extending from upper end 108 to lower end 110, with crest 112 positioned between upper end 108 and lower end 110. Clip 104 may further include a latching section 114 extending from the upper end 108 of the outward curved section 106. Latching section 114 may include U-shaped portion 116, which is configured to engage a receptacle of a grid tee, such as an upward facing receptacle.

Figure 13:
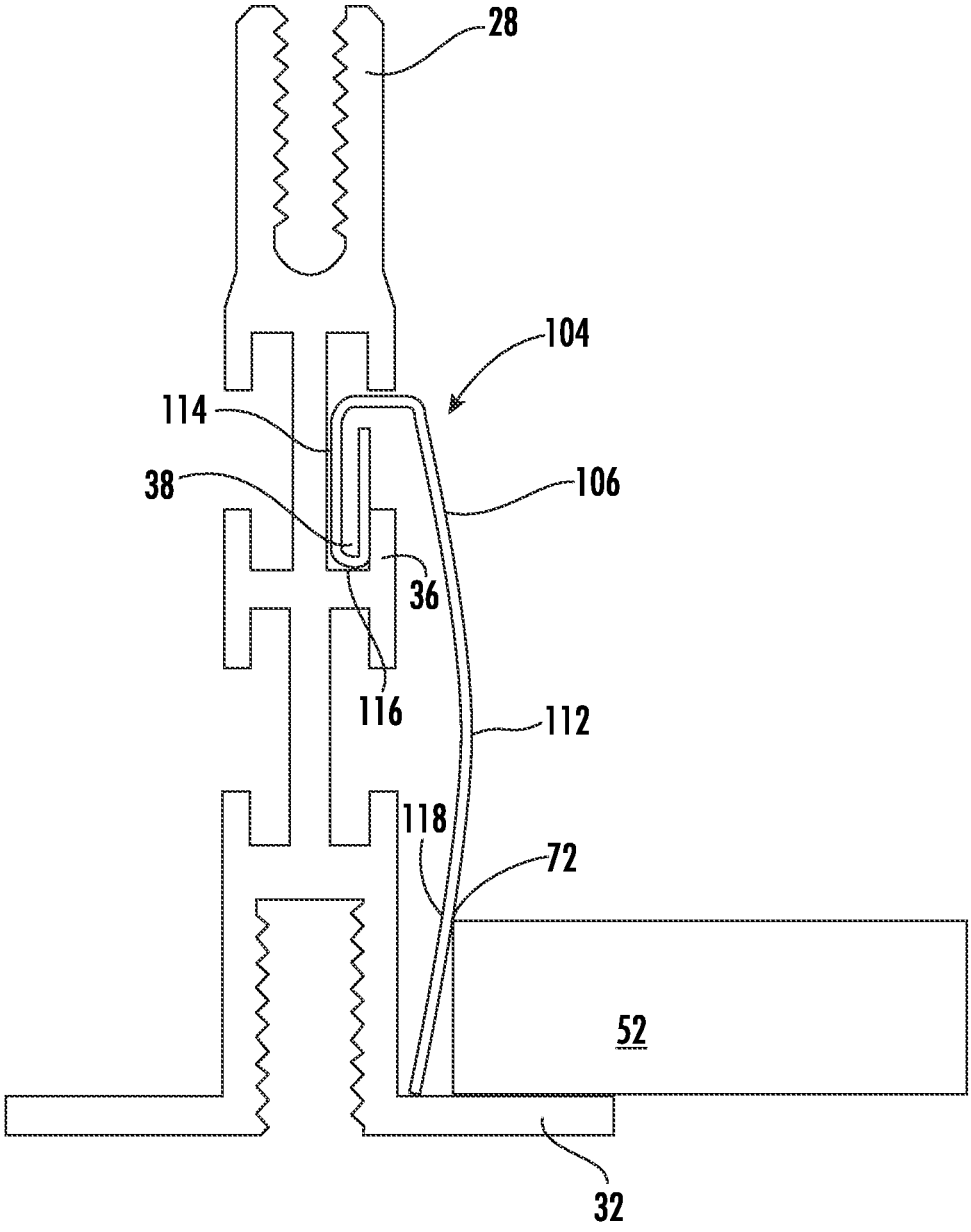
FIG. 13 is a side view of the hold down clip of FIG. 12 installed on a suspended ceiling tee with a ceiling panel installed.

Referring now to FIG. 13, hold down clip 104 may be installed on a grid tee, such as grid tee 28, to retain ceiling panel 52 on horizontal flange 32. U-shaped portion 116 of latching section 114 may engage upward facing receptacle 38 to secure hold down clip 104 to grid tee 28 and to position outward curving section 106 along one side of grid tee 28. Upper edge 72 of ceiling panel 52 may engage contact point 118 of clip 104 below crest 112 of outward curved section 106. Ceiling panel 52 positioned on horizontal flange 32 exerts a compressive force on the lower portion of outward curved section 106 between crest 112 and lower end 110, which causes clip 104 to exert a reactive spring force on upper edge 72 of ceiling panel 52 at contact point 118 of outward curved section 106. Because of the curvature of outward curved section 106 at contact point 118, the spring force includes a vertical vector force in a downward direction that acts to retain ceiling panel 52 in contact with horizontal flange 32 of grid tee 28. In this way, outward curved section 106 is configured to elastically deform to produce reactive forces when in contact with a compressive element, such as a ceiling panel.

Figure 14:
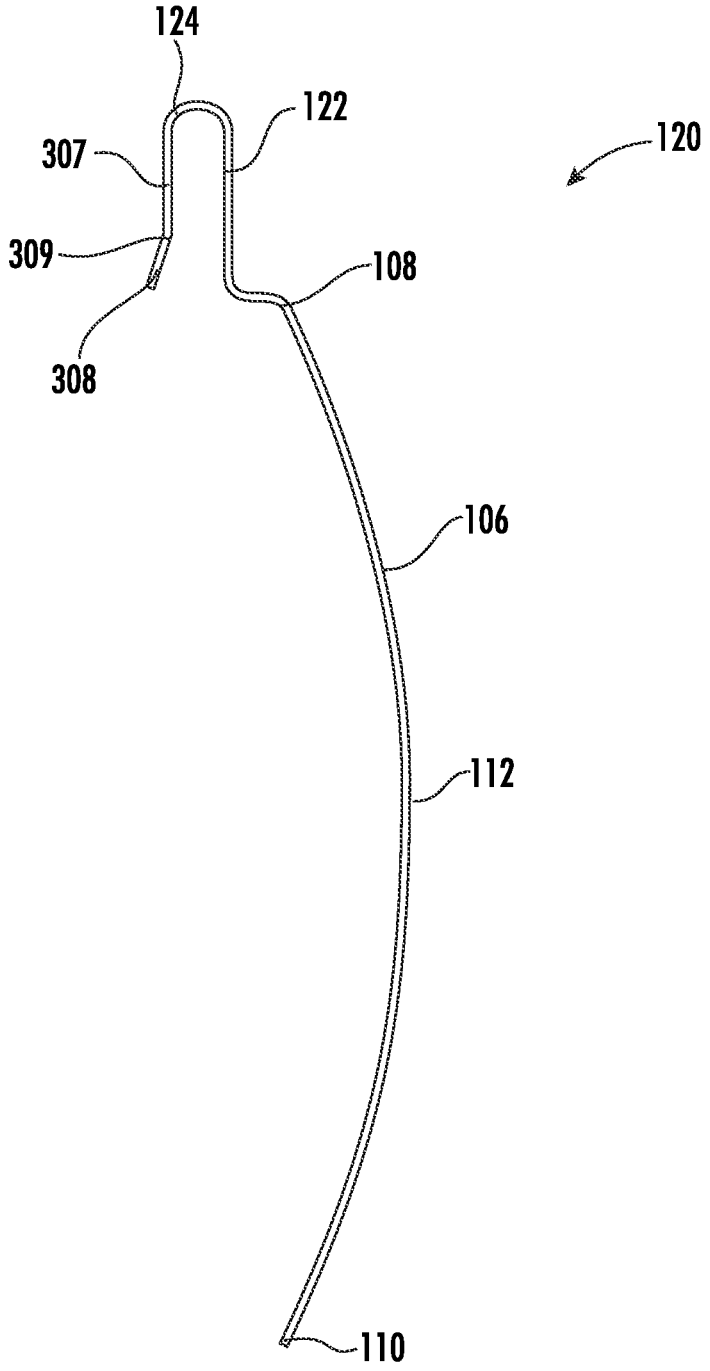
FIG. 14 is a side view of a sixth embodiment of the hold down clip.
Figure 15:
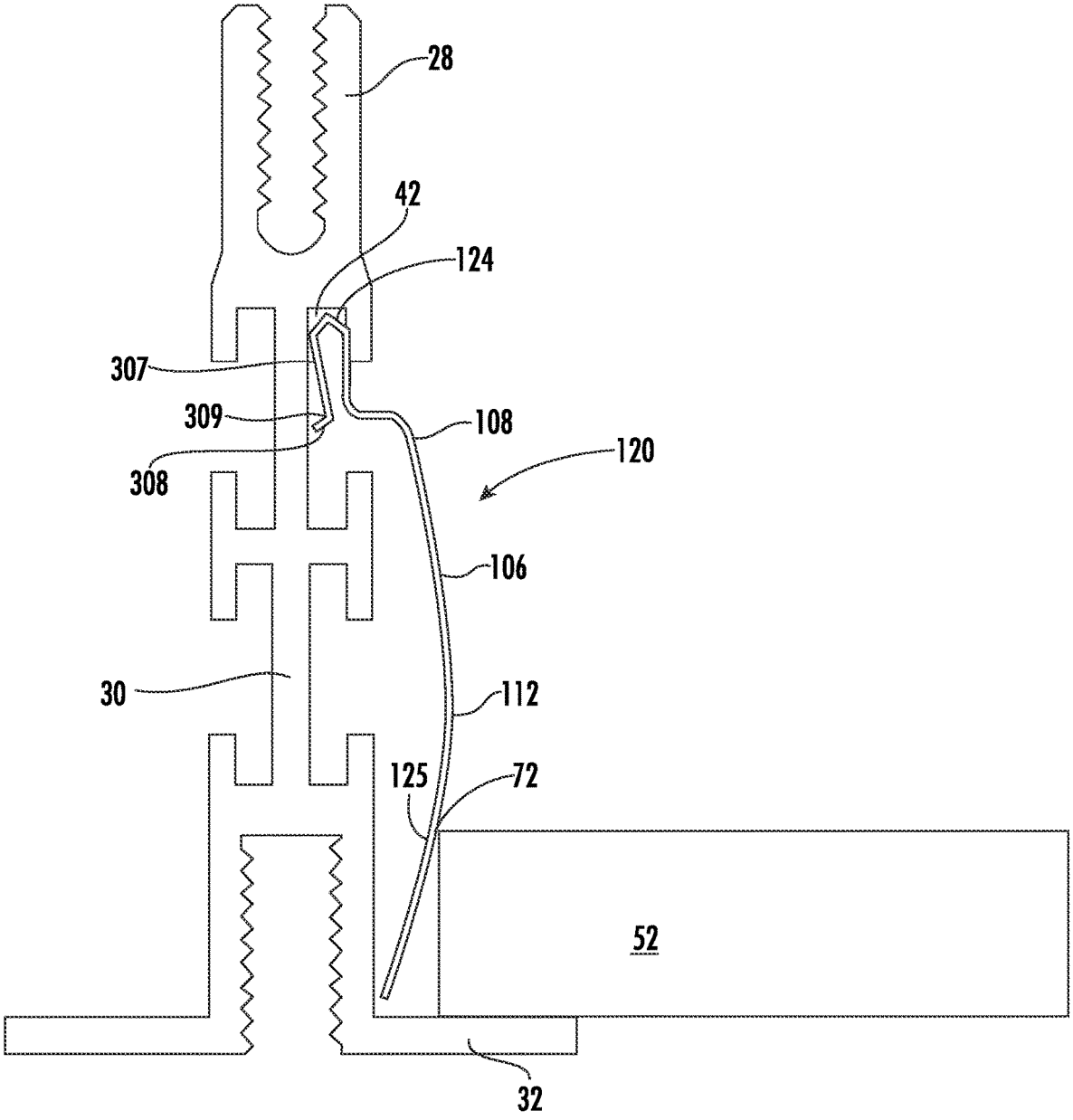
FIG. 15 is a side view of the hold down clip of FIG. 14 installed on a suspended ceiling tee with a ceiling panel installed.

FIGS. 14 and 15 illustrate a sixth embodiment of the hold down clip of the present invention. Hold down clip 120 may include one outward curved section 106 with crest 112 between upper end 108 and lower end 110. Clip 120 may also include a latching section 122 extending from the upper end 108 of outward curved section 106. Latching section 122 may include U-shaped portion 124, which is configured to engage a receptacle of a grid tee, such as a downward facing receptacle. U-shaped portion 124 may include inner arm 307 and sloped end 308 formed by sharp bend 309. As shown in FIG. 15, hold down clip 120 may be installed on grid tee 28 to retain ceiling panel 52 on horizontal flange 32. U-shaped portion 124 of latching section 122 may engage downward facing receptacle 42 of grid tee 28 to secure hold down clip 120 to grid tee 28 and to position outward curving section 106 along one side of grid tee 28. Inner arm 307 of U-shaped section 124 contacts vertical section 30 of grid tee 28. Sloped end 308 and sharp bend 309 exert the outward force of U-shaped portion 124 on vertical section 30 of grid tee 28. This configuration prevents clip 120 from sliding out of downward facing receptacle 42.

Outward curving section 106 may exert a spring force, including a downward vectorial force, on upper edge 72 of ceiling panel 52 at contact point 125 below crest 112, which acts to retain ceiling panel 52 in contact with horizontal flange 32. In this way, outward curved section 106 is configured to elastically deform to produce reactive forces when in contact with a compressive element, such as a ceiling panel.

Figure 16:
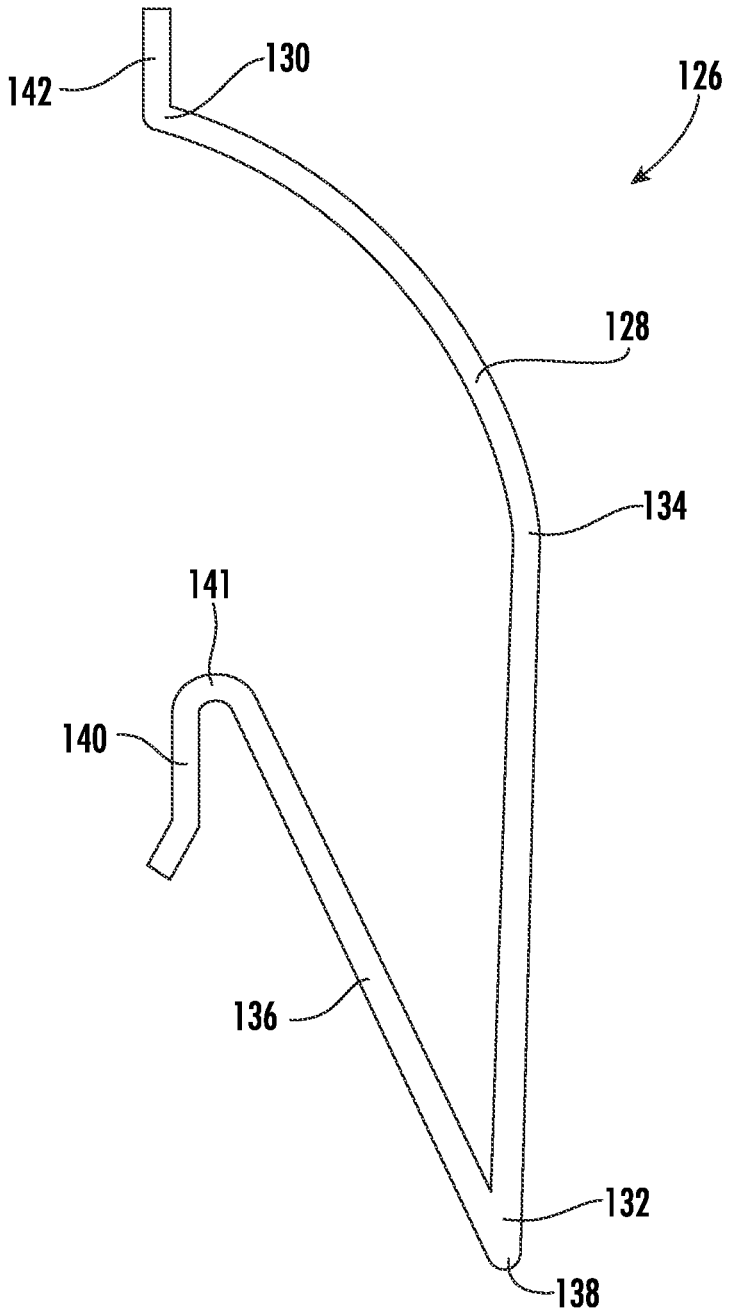
FIG. 16 is a side view of a seventh embodiment of the hold down clip.
Figure 17:
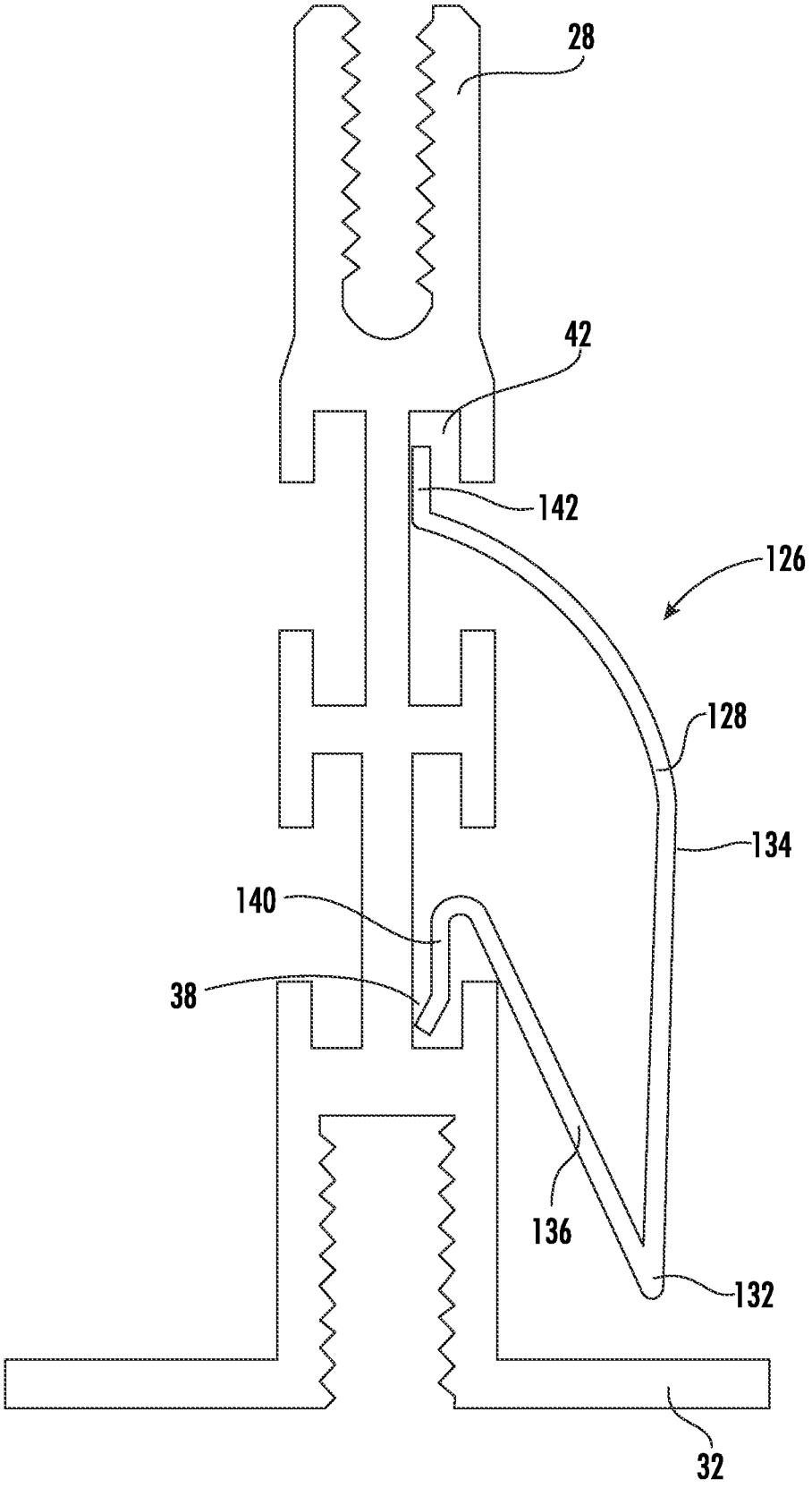
FIG. 17 is a side view of the hold down clip of FIG. 16 installed on a suspended ceiling tee.

FIGS. 16 and 17 illustrate a seventh embodiment of the hold down clip of the present invention. Hold down clip 126 may include one outward curved section 128 extending from upper end 130 to lower end 132, with crest 134 between upper end 130 and lower end 132. Clip 126 may also include latching section 136 extending in an inward direction and an upward direction from lower end 132 of outward curved section 128. At lower end 132 is a small radius curve 138 that joins the outward curved section 128 and latching section 136. The distal end of latching section 136 may include a latching end 140, which is configured to engage a receptacle of a grid tee, such as an upward facing receptacle. Small radius curve 141 may interconnect latching end 140 with the remainder of latching section 136. Clip 126 may further include a second latching section 142 extending from upper end 130 of outward curved section 128. Second latching section 142 may be configured to engage a receptacle of a grid tee, such as a downward facing receptacle. As shown in FIG. 17, hold down clip 126 may be secured to grid tee 28 for retaining a ceiling panel on horizontal flange 32. Latching end 140 of latching section 136 may engage upward facing receptacle 38 of grid tee 28 and second latching section 142 may engage downward facing receptacle 42 of grid tee 28 to position outward curved section 128 along one side of grid tee 28. When a ceiling panel is positioned on horizontal flange 32, it exerts a compressive force on clip 126 in a direction toward grid tee 28. Under the compressive force, latching end 140 and second latching section 142 act to create a spring force, including a downward vector force, that is applied to the ceiling panel at a contact point between crest 134 and lower end 132 of outward curved section 128 to retain the ceiling panel on the horizontal flange 32. In this way, outward curved section 128 and latching section 136 are configured to elastically deform to produce reactive forces when in contact with a compressive element, such as a ceiling panel.

Figure 18:
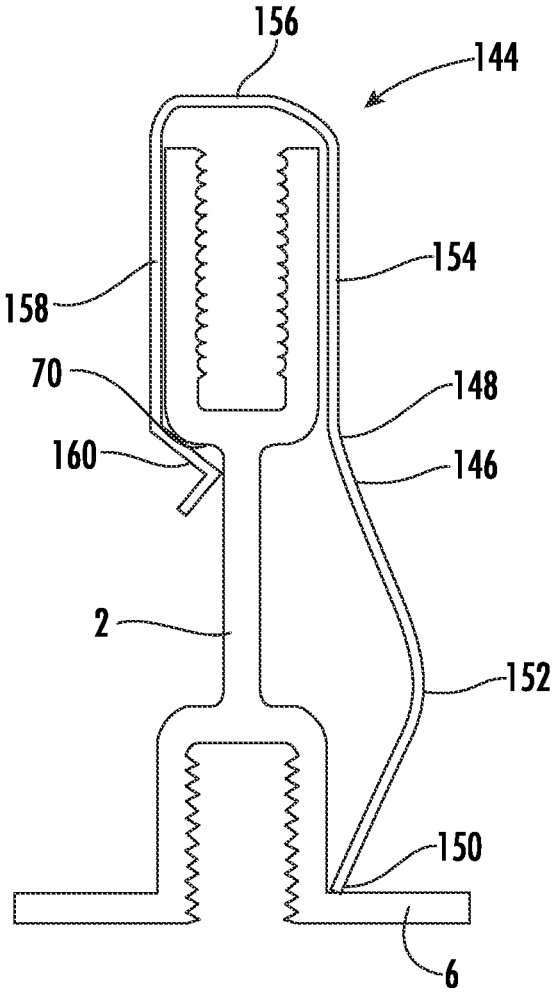
FIG. 18 is a side view of an eighth embodiment of the hold down clip installed on a suspended ceiling tee.

FIG. 18 illustrates an eighth embodiment of the hold down clip of the present invention. Hold down clip 144 may include one outward curved section 146 extending from upper end 148 to lower end 150, with crest 152 positioned between upper end 148 and lower end 150. Clip 144 may also include flat section 154 extending from upper end 148 of outward curved section 146 and bridge section 156 interconnecting flat section 154 and latching section 158. Latching section 158 may include latching end 160 configured to engage a portion of a grid tee. In some embodiments, latching end 160 may be formed of an inward sloped section. Hold down clip 144 may be secured to a grid tee, such as grid tee 2. Bridge section 156 may be positioned over the upper end of grid tee 2 to position flat section 154 and the one outward curved section 146 along one side of grid tee 2 with latching section 158 positioned along the other side of grid tee 2. Latching end 160 may engage shoulder 70 of grid tee 2 to create a spring force that is exerted by a contact point between crest 152 and lower end 150 of outward curved section 146 on a ceiling panel positioned on horizontal flange 6. The slope of outward curved section 146 at the contact point results in the spring force including a downward vector force that retains the ceiling panel on horizontal flange 6. In this way, outward curved section 146 is configured to elastically deform to produce reactive forces when in contact with a compressive element, such as a ceiling panel.

Figure 19:
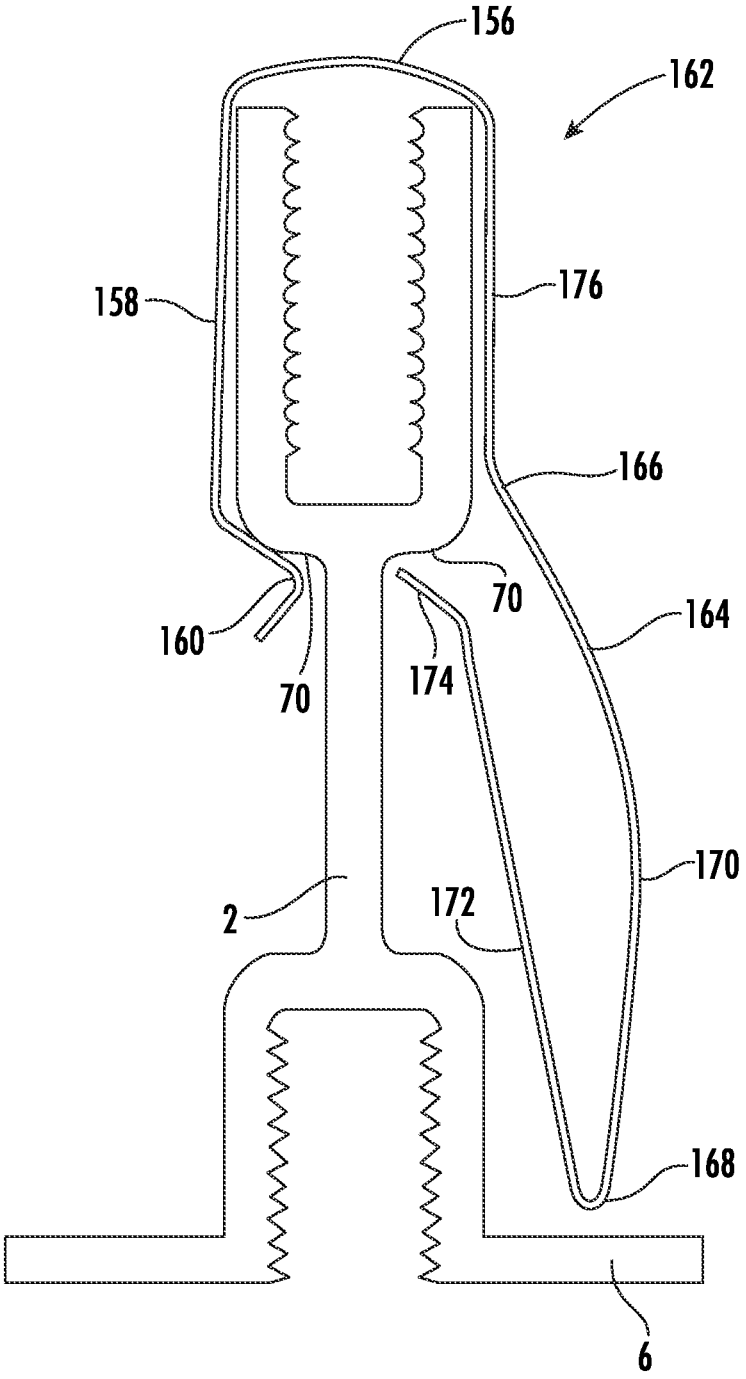
FIG. 19 is a side view of a ninth embodiment of the hold down clip installed on a suspended ceiling tee.

FIG. 19 illustrates a ninth embodiment of the hold down clip of the present invention. Hold down clip 162 may include one outward curved section 164 extending from upper end 166 to lower end 168, with crest 170 positioned between upper end 166 and lower end 168. Clip 162 may also include a first latching section 172 extending in an inward direction and an upward direction from lower end 168 of outward curved section 164. The upper end 174 of the first latching section 172 may be configured to engage a downward facing shoulder of a grid tee. In some embodiments, the upper end 174 includes an inward sloped section. Clip 162 may further include flat section 176 extending from upper end 166 of outward curved section 164 and bridge section 156 interconnecting flat section 176 and second latching section 158. Hold down clip 162 may be secured to a grid tee, such as grid tee 2. Bridge section 156 may be positioned over the upper end of grid tee 2 to position flat section 176, outward curved section 164, and first latching section 172 along one side of grid tee 2 with second latching section 158 positioned along the other side of grid tee 2. Latching end 160 of second latching section 158 and upper end 174 of first latching section 172 may each engage a downward facing shoulder 70 of grid tee 2 to retain clip 162 on grid tee 2. Additionally, these engagements create a spring force that is exerted by a contact point between crest 170 and lower end 168 of outward curved section 164 on a ceiling panel positioned on horizontal flange 6. A downward vector force of the spring force acts to retain the ceiling panel on horizontal flange 6. In this way, outward curved section 164 and first latching section 172 are configured to elastically deform to produce reactive forces when in contact with a compressive element, such as a ceiling panel.

Figure 20:
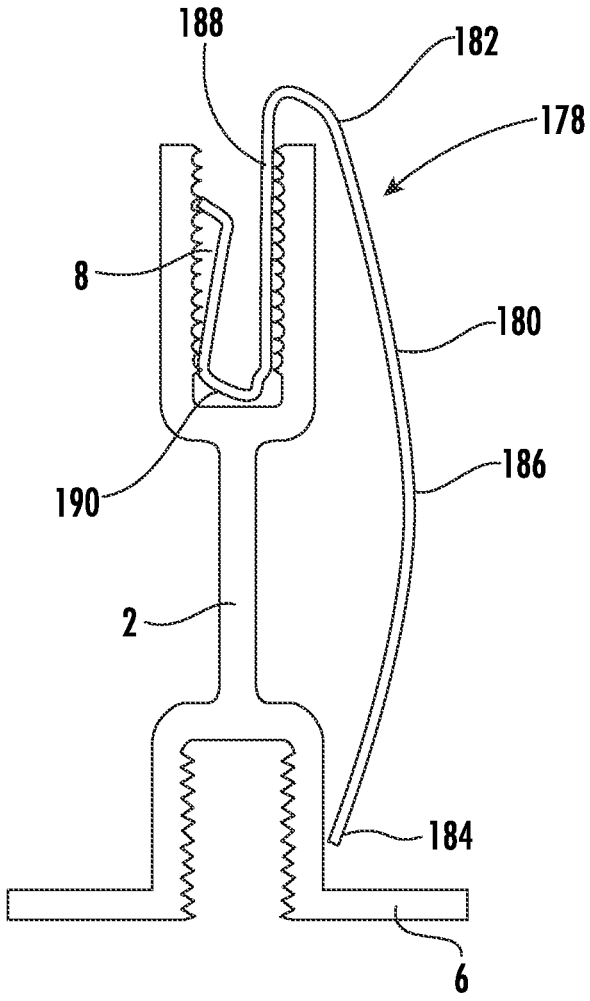
FIG. 20 is a side view of a tenth embodiment of the hold down clip installed on a suspended ceiling tee.

FIG. 20 illustrates a tenth embodiment of the hold down clip of the present invention. Hold down clip 178 may include one outward curved section 180 extending from upper end 182 to lower end 184, with crest 186 positioned between upper end 182 and lower end 184. Clip 178 may also include latching section 188 extending from upper end 182 of outward curved section 180. Latching section 188 may include U-shaped portion 190 configured to engage an upper receptacle of a grid tee. U-shaped portion 190 may be positioned in upper receptacle 8 of grid tee 2 to position the outward curved section 180 along one side of grid tee 2. U-shaped portion 190 may engage the upper receptacle 8 in a configuration that secures clip 178 to grid tee 2 and generates a spring force, including a downward vector force, when a ceiling panel is positioned on horizontal flange 6 of grid tee 2 such that an upper end of the ceiling panel engages a contact point between crest 186 and lower end 184 of outward curved section 180. In this way, outward curved section 180 is configured to elastically deform to produce reactive forces when in contact with a compressive element, such as a ceiling panel.

Figure 21:
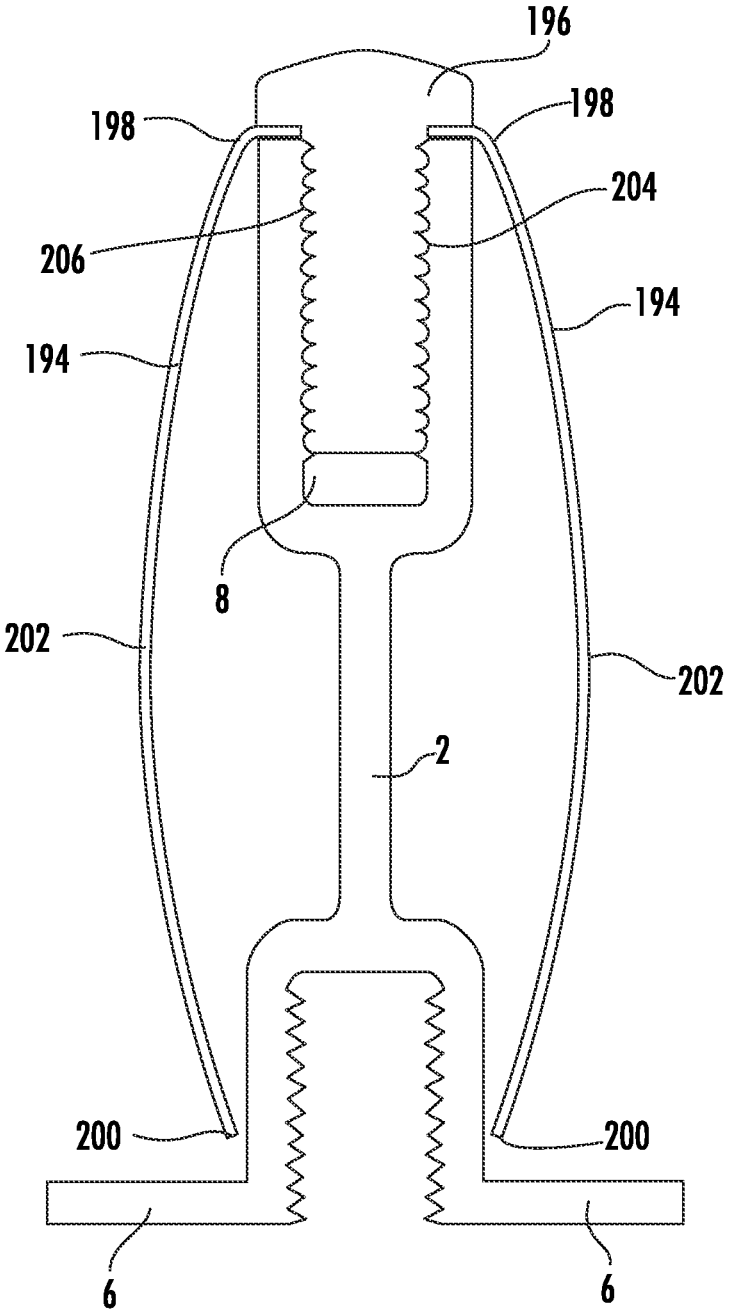
FIG. 21 is a side view of an eleventh embodiment of the hold down clip installed on a suspended ceiling tee.
Figure 22:
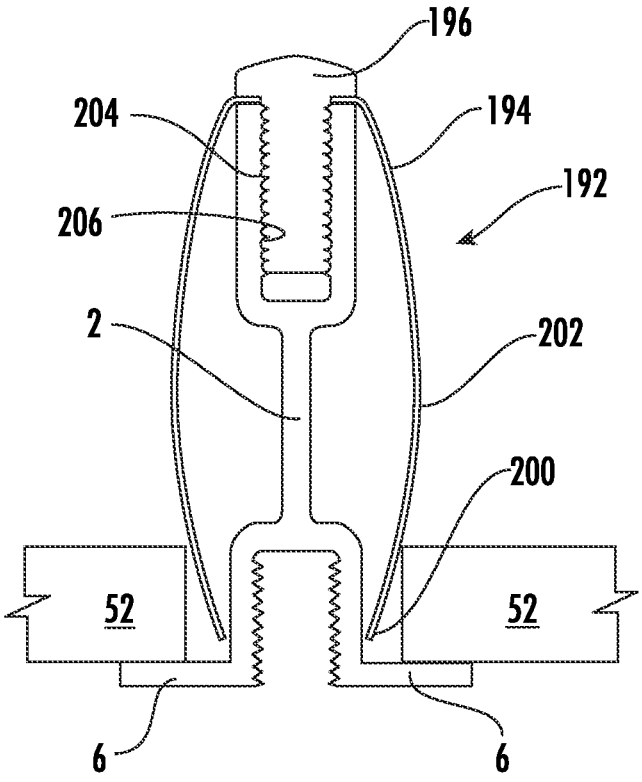
FIG. 22 is a side view of the hold down clip and suspended ceiling tee of FIG. 21 with ceiling panels installed.

FIGS. 21 and 22 illustrate an eleventh embodiment of the hold down clip. Clip 192 may include two outward curved sections 194 extending from two sides of a fastener 196. Each of the outward curved sections 194 may extend from upper end 198 to lower end 200, with crest 202 positioned therebetween. Fastener 196 may include threaded outer surface 204 configured to engage a threaded inner surface of an upper receptacle of a high strength grid tee. For example, threaded outer surface 204 of fastener 196 may engage threaded inner surface 206 of upper receptacle 8 to secure clip 192 to grid tee 2 and to position the two outward curved sections 194 along two sides of grid tee 2. FIG. 21 shows clip 192 in its relaxed state. The outward curved sections 194 are configured to deflect under the pressure applied by ceiling panels 52 when positioned on horizontal flange 6 of grid tee 2 as shown in FIG. 22, which causes outward curved section 194 to apply a spring force (including a downward vector force) on ceiling panels 52. Further deflection of the outward curved sections 194 occurs when ceiling panels 52 are thicker and lower end 200 of outward curved sections 194 touch a surface of grid tee 2. In this way, outward curved sections 194 are configured to elastically deform to produce reactive forces when in contact with a compressive element, such as a ceiling panel.

Figure 23:
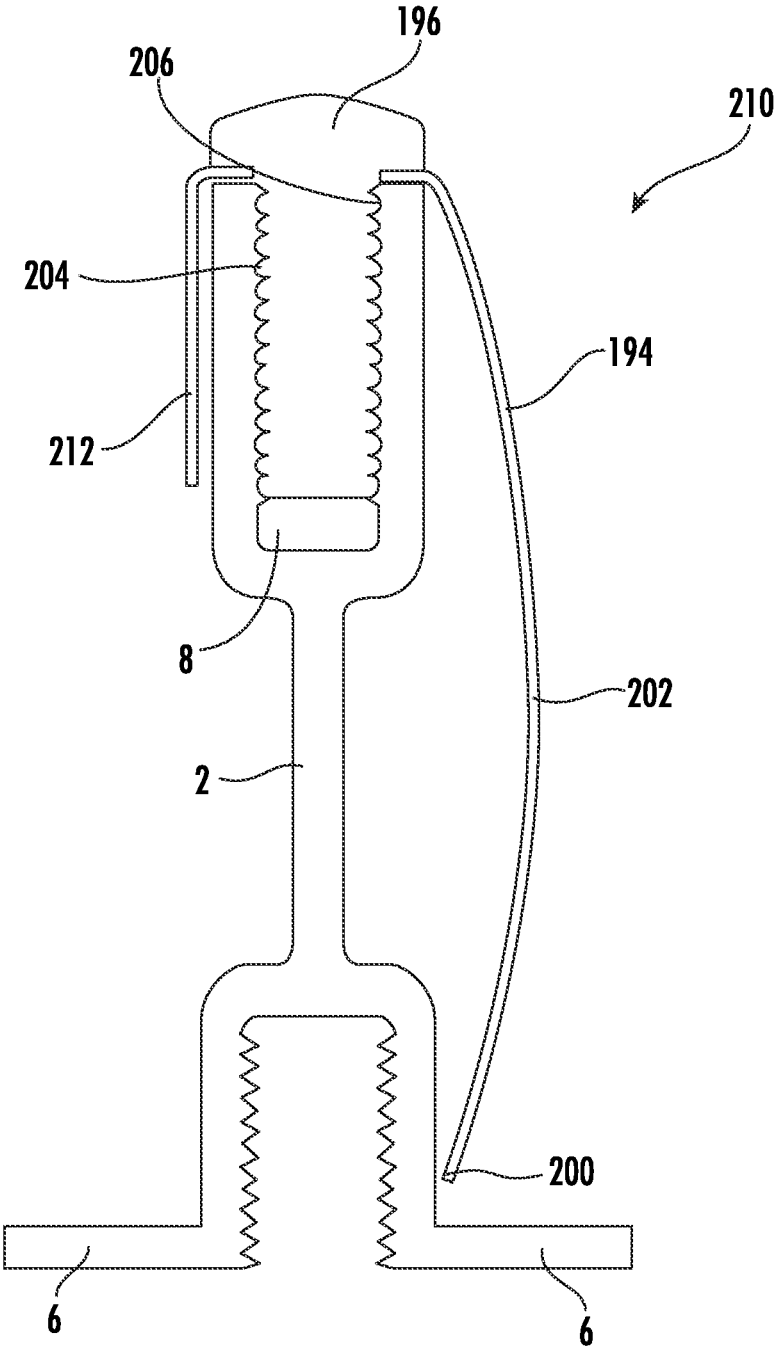
FIG. 23 is a side view of a twelfth embodiment of the hold down clip installed on a suspended ceiling tee.

FIG. 23 illustrates a twelfth embodiment of the hold down clip. Hold down clip 210 includes one outward curved section 194 extending from a first side of fastener 196. Fastener 196 may be configured to engage an upper receptacle of a high strength grid tee. Optionally, clip 210 may include support arm 212 extending from a second side of fastener 196. While fastener 196 provides adequate support to secure clip 210 to a grid tee, support arm 212 may provide additional support and stabilization for clip 210 when installed on a grid tee. For example, clip 210 may be installed on grid tee 2 by securing fastener 196 to upper receptacle 8 to position the outward curved section 194 along a first side of grid tee 2 and to position the support art 212 along a second side of grid tee 2. Fastener 196 and support arm 212 enable outward curved section 194 to apply a spring force including a downward force vector on a ceiling panel positioned on horizontal flange 6 of grid tee 2.

Figure 24:
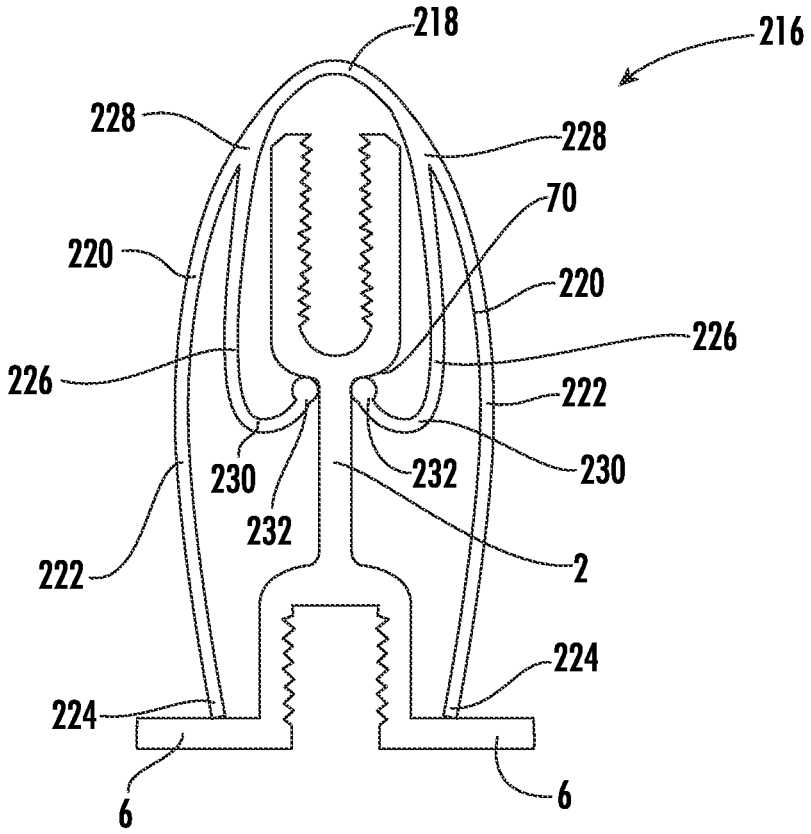
FIG. 24 is a side view of a thirteenth embodiment of the hold down clip installed on a suspended ceiling tee.
Figure 25:
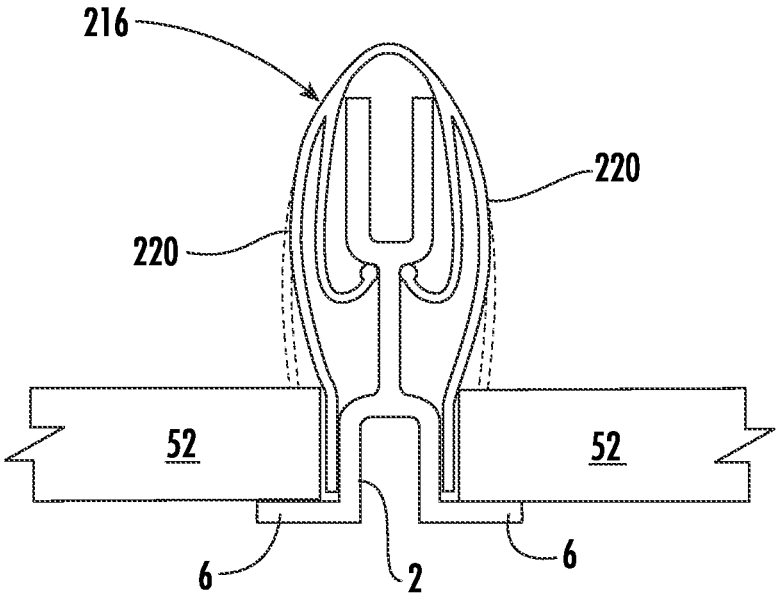
FIG. 25 is a side view of the hold down clip and suspended ceiling tee of FIG. 24 with ceiling panels installed.

FIGS. 24 and 25 illustrate a thirteenth embodiment of the hold down clip. Hold down clip 216 includes bridge section 218 interconnecting two outward curved sections 220, which each extend from the bridge section 218 to crest 222 and further to a lower end 224. Clip 216 may also include latching sections 226 extending in an inward direction and a downward direction from transition points 228 along outward curved sections 220. Transition points 228 may be located above crests 222 of outward curved sections 220, such as near an upper end of each. In some embodiments, latching sections 226 are positioned within outward curved sections 220. Bridge section 218 may be positioned over an upper end of a grid tee, such as grid tee 2, to position outward curved sections 220 on two sides of grid tee 2. Latching sections 226 may each include upward curve 230 extending to distal end 232, which engages shoulder 70 of grid tee 2. Distal ends 232 of latching sections 226 may apply an inward force on grid tee 2, which results in an outward spring force that is applied by a lower portion of outward curved sections 220 when compressed. As shown in FIG. 25, outward curved sections 220 may be compressed when ceiling panels 52 are positioned on horizontal flanges 6. In response to this compression, outward curved sections 220 of clip 216 exert a spring force on ceiling panels 52. The spring force includes a downward vector force that retains ceiling panels 52 on horizontal flanges 6. Clip 216 is preferably constructed of a molded plastic or plastic extrusion.

Figure 26:
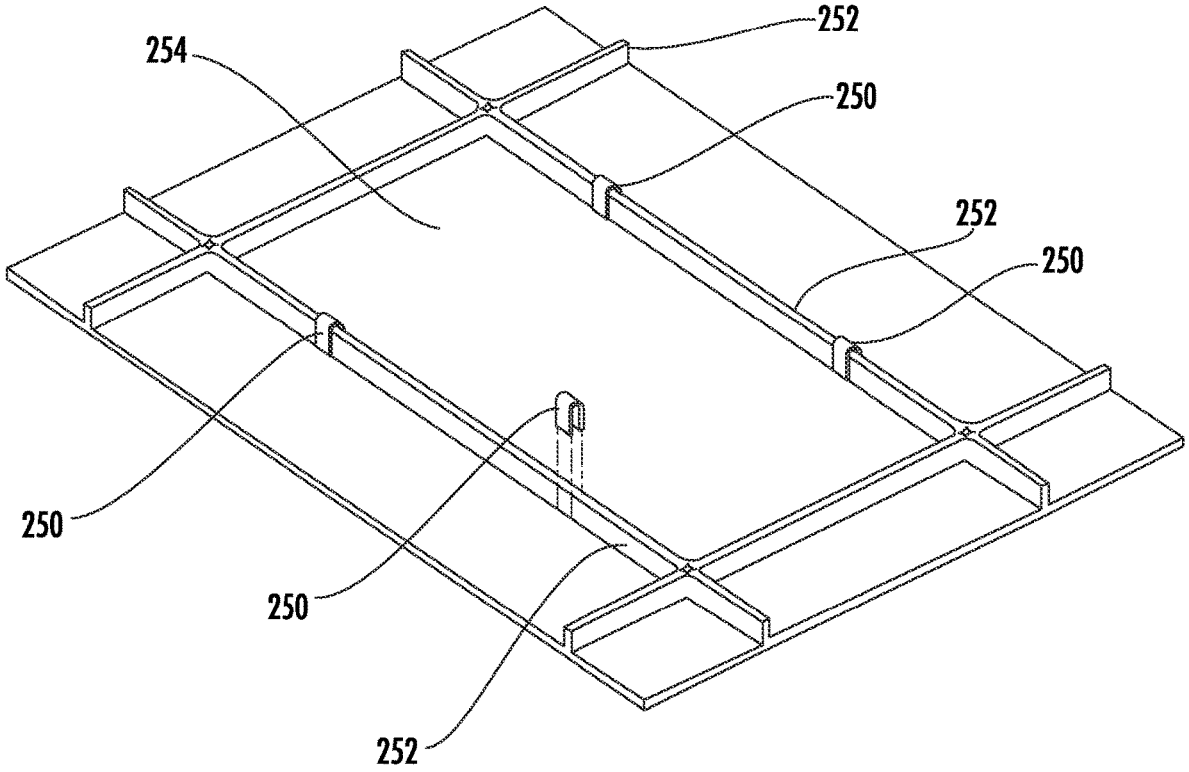
FIG. 26 is a perspective view of hold down clips of the present invention installed on grid tees of a suspended ceiling.

With reference to FIG. 26, each embodiment of hold down clips 250 may be secured along grid tees 252 of a suspended ceiling system. Clips 250 may engage grid tee 252 in any of the configurations discussed in connection with the various embodiments of the hold down clips. A plurality of ceiling panels may be positioned in the spaces between the grid tees. For example, ceiling panel 254 may be positioned on horizontal flanges of the grid tees in a single space. The outer curved sections of the two or more clips 250 that are secured to grid tees 252 may be compressed as ceiling panel 254 moves downward into position on the horizontal flanges. In the compressed shape, clips 250 apply a spring force on ceiling panel 254, which includes a downward vector force that retains ceiling panel 254 on the grid tees. Similarly, adjacent ceiling panels may be held in place on the grid tees with hold down clips 250. In embodiments of the hold down clip 250 that include more than one outward curved section, a single clip 250 may be used to secured two adjacent ceiling panels to the grid tees.

The present invention may of course be carried out in other specific ways than those set forth herein without departing from the scope and the essential characteristics of the invention previously described. The present embodiments are therefore to be construed in all aspects as illustrative and not restrictive and all changes coming within the meaning and equivalency range of the appended claims are intended to be embraced herein.

Except as otherwise described or illustrated, each of the components in this device may be formed of aluminum, steel, another metal, plastic, or any other durable, natural or synthetic material. Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein. Plurality means two or more.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. A suspended ceiling panel hold down clip, comprising:

a first outward curved section extending from an upper end to a lower end and including a crest between the upper end and the lower end; and a first latching section extending in a downward and inward direction from a transition point above the crest of the first outward curved section, wherein the first latching section is continuously formed with the first outward curved section, wherein the first latching section is configured to engage and exert a horizontal, inward force on a grid tee of a suspended ceiling, and wherein the first outward curved section applies a horizontal, outward spring force.

2. The suspended ceiling panel hold down clip of claim 1, further comprising:

a second outward curved section extending from an upper end to a lower end and including a crest between the upper end and the lower end;

a second latching section extending in a downward and inward direction from a transition point above the crest of the second outward curved section, wherein the second latching section is continuously formed with the second outward curved section; and a bridge section interconnecting the upper end of the first outward curved section and the upper end of the second outward curved section, wherein the bridge section is configured to fit over an upper end of the grid tee, and wherein the first and second outward curved sections are configured to be disposed along two sides of the grid tee.

3. The suspended ceiling panel hold down clip of claim 2, wherein the second outward curved section and the second latching section are symmetrical to the first outward curved section and the second latching section.

4. The suspended ceiling panel hold down clip of claim 2, wherein the crests of the first and second outward curved sections are at a greatest distance from a central axis of the grid tee.

5. The suspended ceiling panel hold down clip of claim 1, wherein a distal end of the first latching section is configured to engage a shoulder of the grid tee.

6. The suspended ceiling panel of claim 5, wherein the first latching section includes an upward curve between the transition point and the distal end.

7. The suspended ceiling panel of claim 1, wherein the first latching section is positioned within the first outward curved section.

8. The suspended ceiling panel of claim 2, wherein the second latching section is configured to engage and exert a horizontal, inward force on the grid tee, and wherein the second outward curved section applies a horizontal, outward spring force.

* * * * *